US007415236B2

(12) United States Patent
Nakano et al.

(10) Patent No.: US 7,415,236 B2
(45) Date of Patent: Aug. 19, 2008

(54) CLEANING UNIT, PROCESS CARTRIDGE, AND IMAGE-FORMING APPARATUS

(75) Inventors: Tohru Nakano, Kanagawa (JP); Osamu Naruse, Kanagawa (JP); Masanori Horike, Kanagawa (JP); Masahiko Katoh, Kanagawa (JP); Masahiko Shakuto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 380 days.

(21) Appl. No.: 10/817,249

(22) Filed: Apr. 5, 2004

(65) Prior Publication Data

US 2004/0197122 A1 Oct. 7, 2004

(30) Foreign Application Priority Data

Apr. 7, 2003 (JP) ..... 2003-103234
May 9, 2003 (JP) ..... 2003-131113

(51) Int. Cl.
*G03G 21/00* (2006.01)

(52) U.S. Cl. ..... 399/350; 399/71; 399/351

(58) Field of Classification Search ..... 399/350, 399/71, 351
See application file for complete search history.

(56) References Cited

U.S. PATENT DOCUMENTS 4,173,402 A 11/1979 Horike et al.
4,178,595 A 12/1979 Jinnai et al.
4,217,595 A 8/1980 Horike et al.
4,228,440 A 10/1980 Horike et al.
4,231,047 A 10/1980 Iwasaki et al.
4,231,048 A 10/1980 Horike et al.
4,281,332 A 7/1981 Horike
4,286,273 A 8/1981 Horike
4,288,797 A 9/1981 Horike et al.
4,293,865 A 10/1981 Jinnai et al.
4,310,846 A 1/1982 Horike
4,313,123 A 1/1982 Jinnai et al.

(Continued)

FOREIGN PATENT DOCUMENTS

JP 62-201489 9/1987

(Continued)

OTHER PUBLICATIONS

U.S. Appl. No. 11/370,057, filed Mar. 8, 2006, Yamada et al.

(Continued)

*Primary Examiner*—David M. Gray
*Assistant Examiner*—Ryan D Walsh
(74) *Attorney, Agent, or Firm*—Oblon, Spivak, McClelland, Maier & Neustadt, P.C.

(57) ABSTRACT

A cleaning unit for removing toner remaining on the surface of the image carrier of an image-forming apparatus is disclosed. The cleaning unit includes a vibration member, a blade member, and a driving part. The vibration member extends in the direction of the width of the image carrier, and has at least one vibration application part attached thereto. The blade member is attached to at least the end region of the vibration member, extending in the direction of the width of the image carrier. The driving part drives at least one vibration application part at a driving frequency that is a resonance frequency. The vibration member provides vibration to the blade member and a force to press the blade member against the image carrier.

16 Claims, 21 Drawing Sheets

U.S. PATENT DOCUMENTS

| | | | | |
|---|---|---|---|---|
| 4,364,060 | A | | 12/1982 | Jinnai et al. |
| 4,364,061 | A | | 12/1982 | Horike et al. |
| 4,365,255 | A | | 12/1982 | Horike et al. |
| 4,370,664 | A | | 1/1983 | Horike et al. |
| 4,393,385 | A | | 7/1983 | Jinnai et al. |
| 4,395,717 | A | | 7/1983 | Horike et al. |
| 4,400,705 | A | | 8/1983 | Horike |
| 4,418,352 | A | | 11/1983 | Horike et al. |
| 4,426,652 | A | | 1/1984 | Horike et al. |
| 4,429,317 | A | | 1/1984 | Umezawa et al. |
| 4,434,428 | A | | 2/1984 | Horike et al. |
| 4,435,720 | A | | 3/1984 | Horike et al. |
| 4,437,101 | A | | 3/1984 | Ebi et al. |
| 4,502,055 | A | | 2/1985 | Horike et al. |
| 4,504,844 | A | | 3/1985 | Ebi et al. |
| 4,510,509 | A | | 4/1985 | Horike et al. |
| 4,520,367 | A | | 5/1985 | Ishikawa et al. |
| 4,535,339 | A | | 8/1985 | Horike et al. |
| 4,550,321 | A | | 10/1985 | Sato et al. |
| 4,558,995 | A | | 12/1985 | Furukawa et al. |
| 4,562,442 | A | | 12/1985 | Jinnai et al. |
| 4,626,867 | A | | 12/1986 | Furukawa et al. |
| 4,677,845 | A | | 7/1987 | Izumi et al. |
| 4,800,398 | A | | 1/1989 | Naruse et al. |
| 4,834,533 | A | | 5/1989 | Horike et al. |
| 4,847,631 | A | | 7/1989 | Naruse et al. |
| 5,146,236 | A | | 9/1992 | Hirata et al. |
| 5,260,723 | A | | 11/1993 | Naruse et al. |
| 5,270,740 | A | | 12/1993 | Naruse et al. |
| 5,412,413 | A | | 5/1995 | Sekiya et al. |
| 5,508,477 | A | | 4/1996 | Kato et al. |
| 5,600,356 | A | | 2/1997 | Sekiya et al. |
| 5,818,482 | A | | 10/1998 | Ohta et al. |
| 5,842,102 | A | * | 11/1998 | Montfort et al. ..... 399/349 |
| 5,937,228 | A | | 8/1999 | Shoji et al. |
| 6,115,576 | A | | 9/2000 | Nakano et al. |
| 6,128,461 | A | * | 10/2000 | Yoshikawa ..... 399/350 |
| 6,215,974 | B1 | | 4/2001 | Katoh et al. |
| 6,366,751 | B1 | | 4/2002 | Shakuto et al. |
| 6,611,672 | B2 | | 8/2003 | Aoki et al. |
| 6,625,409 | B2 | | 9/2003 | Shakuto et al. |
| 6,640,073 | B2 | | 10/2003 | Kurotori et al. |
| 6,654,579 | B2 | | 11/2003 | Shakuto et al. |
| 6,708,014 | B2 | | 3/2004 | Miyaguchi et al. |
| 6,721,523 | B2 | | 4/2004 | Sugiura et al. |
| 6,735,408 | B2 | | 5/2004 | Yoshino et al. |
| 6,738,592 | B2 | | 5/2004 | Sasaki et al. |
| 2002/0057927 | A1 | * | 5/2002 | Kobayashi et al. ..... 399/159 |

FOREIGN PATENT DOCUMENTS

| | | | |
|---|---|---|---|
| JP | 05188832 | A * | 7/1993 |
| JP | 6-51673 | | 2/1994 |
| JP | 11-30938 | | 2/1999 |
| JP | 2000-267536 | | 9/2000 |
| JP | 2001-188452 | | 7/2001 |

OTHER PUBLICATIONS

U.S. Appl. No. 11/370,823, filed Mar. 9, 2006, Nakagawa et al.
U.S. Appl. No. 11/376,434, filed Mar. 16, 2006, Takahashi et al.
U.S. Appl. No. 11/011,193, filed Dec. 15, 2004, Nakazato et al.
U.S. Appl. No. 11/126,233, filed May 11, 2005, Naruse, et al.

* cited by examiner

CIRCUMFERENCE : L1

PARTICLE PROJECTED AREA : S

CIRCLE OF AREA S

CIRCUMFERENCE : L2

$$\text{CIRCULARITY} = \frac{L2}{L1}$$

CLEANING UNIT, PROCESS CARTRIDGE, AND IMAGE-FORMING APPARATUS

BACKGROUND OF THE INVENTION

1. Field of the Invention

The present invention relates generally to cleaning units, process cartridges, and image-forming apparatuses, and more particularly to a cleaning unit employed in electrophotographic or electrostatographic image-forming apparatuses such as copiers, printers, and facsimile machines, a process cartridge including the cleaning unit, and an image-forming apparatus including the process cartridge.

2. Description of the Related Art

According to electrophotographic image-forming apparatuses such as printers, facsimile machines, and copiers, an electrostatic latent image formed by charging the surface of an image carrier and exposing the surface to light is developed with colored toner so that a toner image as a visible image is formed. Then, the toner image is, directly or after being transferred to an intermediate transfer member, transferred to a transfer medium such as transfer paper, and is fixed by a heating roller so that an image is formed.

Generally, untransferred toner remains on the surface of the image carrier after the transfer of the toner image. Accordingly, it is necessary to remove the remaining (residual) toner by cleaning means prior to the next image-forming process. Generally, the cleaning means removes not only the remaining toner but also other foreign substances adhering to the surface of the image carrier.

As the cleaning means for removing the remaining toner after the transfer of the toner image, a variety of methods such as those using a fur brush, a magnetic brush, and a cleaning blade whose material is an elastic body such as rubber have been employed. The method of scraping off the remaining toner by rubbing the image carrier with the cleaning blade (a blade cleaning method) is commonly employed since the method is inexpensive and highly stable in performance. The elastic body employed as the material of the cleaning blade is often polyurethane rubber having good wear resistance.

In recent years, toner particles have become smaller in size (diameter) and spherical in shape in order to achieve high image quality in full-color image-forming apparatuses. The dot reproducibility of a toner image formed on the surface of the image carrier can be improved by reducing the particle size of toner, and the developability and the transferability of the toner can be improved by making the particle shape spherical.

As a method of forming spherical toner (particles) for achieving high image quality, the conventional pulverization method has been replaced by a polymerizing method accompanied by the chemical reaction of polymerization. The polymerizing method, which has variations within the same category of polymerization reaction, is advantageous in that a pulverization and classification process employed in forming pulverized toner can be dispensed with or greatly simplified.

The use of the above-described toner of small-size spherical particles, which hereinafter may be referred to as spherical toner, may cause a problem in that good cleaning performance cannot be obtained by the blade cleaning method. That is, it is difficult to completely remove the remaining toner on the surface of the image carrier with the cleaning means, thus resulting in poor cleaning performance or imperfect cleaning.

It is known that this poor cleaning performance or imperfect cleaning occurs even in the case of making the conventional pulverized toner small in particle size and spherical in particle shape by mechanical processing (re-pulverization) or heat treatment. When toner becomes small in particle size and spherical in particle shape, the blade cleaning method cannot achieve good cleaning performance irrespective of the method of manufacturing the toner.

The toner that has been cleaned imperfectly results in a quality defect of the next image to be formed and output. Particularly, if a charger is of a contact type having a roller shape, the toner that cannot be removed (cleaned) by the cleaning blade may be deposited on the roller-like charger to cause incomplete charging, thus exerting a great influence.

Particularly, a cleaning characteristic remarkably worsens when the (particle) circularity of toner, which is described in detail below, is close to one, that is, when almost all of the toner particles are spheres in shape. Further, even if the toner has a circularity less than or equal to 0.95 in shape, the toner includes substantially spherical particles since the toner particles have a shape distribution. Accordingly, the cleaning characteristic tends to worsen over time.

Further, the cleaning characteristic tends to worsen as the particles of toner employed for development become smaller in size. The image-forming apparatuses are employed within the temperature range of approximately 10 to 30° C. Particularly, at low temperatures, the cleaning characteristic shows remarkable deterioration.

According to the cleaning method using the cleaning blade, the remaining toner is scraped off by rubbing the surface of the image carrier with the rubber blade as described above. Therefore, the tip of the edge of the rubber blade deforms due to the frictional resistance between the image carrier and the rubber blade, thus forming a minute wedge-like space therebetween. The smaller the toner particles are, the more easily the toner particles enter the tip of the edge in this space. The toner particles that have entered the tip of the edge are difficult to replace, thus forming a non-fluid area.

Further, it is easier to perform closest packing on the spherical toner than on irregularly shaped toner. Therefore, the spherical toner is likely to be compacted in the minute space in the vicinity of the contact point between the edge of the cleaning blade and the image carrier. When the frictional resistance between the toner in the non-fluid area and the image carrier is relatively small so that the toner slides relative to the image carrier, imperfect cleaning is prevented from occurring. However, when an external additive is removed from the toner by its sliding and rubbing on the image carrier so that the friction between the toner and the image carrier increases, the spherical toner, whose rolling friction is smaller than that of the conventional irregularly shaped toner, starts to roll and slips through between the cleaning blade and the image carrier.

Japanese Laid-Open Patent Application No. 2001-188452 (Prior Art 1) discloses a cleaning unit that, in order to efficiently remove residual toner on the image carrier of an image-forming apparatus using spherical toner manufactured by the polymerizing method, includes: a cleaning blade scraping the residual toner off the surface of the photosensitive body (image carrier) after the transfer of a toner image; and a cleaning brush disposed on the upstream side of the cleaning blade in a direction in which the photosensitive body moves, the cleaning brush pulverizing the residual toner so as to produce pulverized toner on the photosensitive body.

Japanese Laid-Open Patent Application No. 2000-267536 (Prior Art 2) discloses an image-forming apparatus that, in order to improve the cleaning characteristic of a cleaning blade for cleaning an image carrier with respect to spherical toner, includes: a toner image carrier whose surface carrying a toner image formed by spherical toner rotates through a transfer area and a cleaning area; a transfer device that transfers the toner image on the surface of the toner image carrier onto a transfer material when the surface passes through the transfer area; a cleaning blade formed of an elastic member, the cleaning blade having a blade edge that comes into frictional contact with the surface of the toner image carrier so as to remove residual toner thereon when the surface passes through the cleaning area; and a toner image carrier cleaner having a powdery mixture material applied to the blade edge of the cleaning blade, the powdery mixture material being composed of a powdery lubricant and irregularly shaped toner whose average particle size is smaller than that of the spherical toner.

Japanese Laid-Open Patent Application No. S62-201489 (Prior Art 3) discloses a cleaning unit for an image-forming apparatus, the cleaning unit having a cleaning blade that is forced to vibrate in order to shake off toner and foreign substances being adhered to the cleaning blade and to prevent the occurrence of noise caused by the straight contact of the cleaning blade with a photosensitive body.

Japanese Laid-Open Patent Application No. 6-051673 (Prior Art 4) discloses a cleaning unit including vibration application means that comes into contact with the surface of a photosensitive body and applies vibration thereto. The vibration application means generates vibration vertically, laterally, or vertically and laterally so as to increase the capability of cleaning residual toner.

Japanese Laid-Open Patent Application No. 11-030938 (Prior Art 5) discloses a cleaning unit including vibration means provided to the fixed end (non-cleaning part) of a cleaning blade, the vibration means applying vibration to the cleaning blade so as to loosen the particles and remove the particles from a surface.

However, the cleaning unit according to Prior Art 1, which includes the cleaning brush pulverizing the residual toner so as to produce pulverized toner on the photosensitive body, is large in size. Further, it is very difficult to pulverize toner formed of resin, and even if it is possible to pulverize the toner, the pulverization causes damage to the surface of the image carrier, thus degrading image quality.

According to the image-forming apparatus of Prior Art 2, which uses the powdery mixture material including the irregularly shaped toner having a smaller average particle size than the spherical toner, the merit of improved image quality obtained by using the spherical toner is reduced, thus resulting in the degradation of image quality. The irregularly shaped toner may be transferred so as to degrade the quality of dots formed by the toner.

According to Prior Art 3, vibration application means causing large displacement is required to produce the desired effect, and the practical application of the technique of Prior Art 3 to high-speed printing is difficult.

According to Prior Art 4, it is difficult to produce the desired effect over the entire width of the photosensitive body. The same applies to Prior Art 5.

Further, the cleaning units of Prior Art 3, 4 and 5 only apply vibration to shake off toner adhering to the cleaning blade or loosen toner from the surface of the image carrier, and do not apply vibration responding to the mechanism of the occurrence of imperfect cleaning of the spherical toner. Accordingly, imperfect cleaning occurs in the case of the spherical toner.

Therefore, the inventors of the present invention have studied the mechanism of the occurrence of imperfect cleaning caused by a counter-type cleaning blade in the case of using the spherical toner, and have clarified the cause of the occurrence of imperfect cleaning.

FIG. 1 is a diagram showing a cleaning unit using a typical counter-type cleaning blade 101. According to the cleaning unit of FIG. 1, the end (free end) of the cleaning blade 101 held by a metal holder 100 is caused to come into contact with an image carrier 111 in the counter direction of a direction indicated by arrow A in which the image carrier 111 rotates so that an angle θ is formed between a ventral surface 101*c* of the cleaning blade 101 and the surface of the image carrier 111. The free end of the cleaning blade 101 is pressed against the image carrier 111 by an amount d so as to remove residual toner on the image carrier 111.

Normally, the conventional cleaning blade 101 is an elastic rubber member whose principal component is polyurethane rubber. Generally, the cleaning blade 101 has a JIS-A hardness of 65 to 70°, a thickness of approximately 1.5 to 2.0 mm, and a blade free length (protrusion) from the metal holder of 8 to 15 mm, and the contact angle θ is set to 20 to 30°.

When the image carrier 111 rotates with the cleaning blade thus being in contact therewith, the movement of the image carrier 111 in the A direction causes an edge part 101*b* of a cut surface (end surface) 101*a* of the cleaning blade 101, which is an elastic member, to be pulled in the A direction by the friction between the edge part 101*b* and the image carrier 111. As a result, the cut surface 101*a* of the blade 101 deforms to turn in the A direction as shown in FIG. 2. This turning of the cut surface 101*a* forms a nip part N having a wedge-like shape between the cut surface 101*a* of the end of the blade 101 and the image carrier 111.

In this case, if pulverized toner Ta is used, the edge portions of the distortedly shaped particles of the pulverized toner Ta are caught in the wedge-shaped nip part N formed between the cleaning blade 101 and the image carrier 111 as shown in FIG. 3. At this point, repulsion to bring back the deformed portion of the cut surface 101*a* of the blade 101 to its original state is exerted thereon, thus causing so-called stick and slip motion to occur.

A description is now given, with reference to FIG. 4, of the stick and slip motion. When the blade nip sticks to the surface of the moving image carrier 111, the blade nip is forced to extend in the rotational direction of the image carrier 111 (the A direction) as indicated by a broken line in FIG. 4. When the blade nip is extended to a certain position, the repulsion of the blade 101 becomes so large that the blade nip slides on the surface of the image carrier 111 when a static frictional force and the repulsion are balanced. When the blade nip slides on the image carrier, a coefficient of dynamic friction is smaller than a coefficient of static friction. Accordingly, the blade nip returns to its original position (indicated by a solid line) while slipping on the surface of the image carrier 111. The returning force of the repeated stick and slip motion (whose range is indicated by SP in FIG. 4) causes the toner Ta remaining in the wedge-like nip part N to receive a force to return the toner Ta in the direction opposite to the traveling direction of the image carrier 111. As a result, the toner Ta is cleaned.

On the other hand, a description is given below, with reference to FIG. 5, of the case of employing the spherical toner. FIG. 5 is a diagram showing the behavior of spherical toner Tb when the spherical toner Tb enters the wedge-shaped nip part N formed between the cleaning blade 101 and the image carrier 111.

In the case of using the spherical toner Tb, its particles, which, unlike those of the pulverized toner Ta, have no distorted portions, are not caught by the end part of the blade 101. Therefore, the spherical toner Tb, entering the wedge-shaped nip part N to be held between the blade 101 and the image carrier 111, receives a moment rotating because of the friction between the spherical toner Tb and the image carrier 111 with their contact part serving as a driving source. Accordingly, the spherical toner Tb, rotating in the direction opposite to the traveling direction of the image carrier 111, moves in the same direction as the rotational direction of the image carrier 111 to slip through between the blade 101 and the image carrier 111, thus resulting in imperfect cleaning.

At this point, once the "slip through" of the spherical toner Tb occurs, the spherical toner Tb functions as lubricant between the cleaning blade 101 and the image carrier 111 as shown in FIG. 6. The spherical toner Tb functions to reduce the friction between the end part of the blade 101 and the image carrier 111 and release the turning of the cut surface 101*a* of the blade 101 (or return the blade 101 to its original shape). Therefore, the above-described stick and slip motion, which is the basic function of the cleaning by the blade 101, is prevented from occurring, thus causing the phenomenon of the successive occurrences of imperfect toner cleaning (removal).

The above description is given of the mechanism of the occurrence of imperfect cleaning of the spherical toner. On the other hand, in the case of toner of a small particle size, it has also been confirmed that the smaller the toner particles are, the more easily the toner enters the wedge-shaped nip part N shown in FIG. 3. Further, it has also been confirmed that even if the particles of the toner that has entered the nip part N are distorted in shape, the toner particles are caught in the nip part N less easily as the toner particles become smaller in size, thus making it easier for the toner particles of a smaller size to slip through between the blade 101 and the image carrier 111.

SUMMARY OF THE INVENTION

Accordingly, it is a general object of the present invention to provide a cleaning unit in which the above-described disadvantages are eliminated, a process cartridge including the cleaning unit, and an image-forming apparatus including the process cartridge.

A more specific object of the present invention is to provide a cleaning unit having a better cleaning characteristic, preventing the occurrence of imperfect toner removal, a process cartridge including the cleaning unit, and an image-forming apparatus including the process cartridge.

The above objects of the present invention are achieved by a cleaning unit for removing toner remaining on a surface of an image carrier of an image-forming apparatus, including: a vibration member extending in a direction of a width of the image carrier, the vibration member having at least one vibration application part attached thereto; a blade member attached to at least an end region of the vibration member, the blade member extending in the direction of the width of the image carrier; and a driving part configured to drive the at least one vibration application part at a driving frequency, the driving frequency being a resonance frequency, wherein the vibration member is configured to provide vibration to the blade member and a force to press the blade member against the image carrier.

According to the above-described cleaning unit, the vibration application part for vibrating the cleaning blade may be driven with a resonance frequency being employed as a driving frequency. Accordingly, vibration can be secured so that a cleaning characteristic can be maintained.

The above objects of the present invention are also achieved by a process cartridge freely attachable to and detachable from a main body of an image forming apparatus including at least one of an image carrier, a charging unit, a development unit, and a transfer unit, and the above-described cleaning unit.

According to this process cartridge, cleaning deficiency is eliminated so that a high-quality image can be formed.

The above objects of the present invention are also achieved by an image-forming apparatus forming an image by electrophotography including the above-described cleaning unit.

According to this image-forming apparatus, cleaning deficiency is eliminated so that a high-quality image can be formed.

The above objects of the present invention are also achieved by an image-forming apparatus forming a color image, including a plurality of process cartridges freely attachable to and detachable from a main body of the image forming apparatus, the process cartridges each being the above-described process cartridge according to the present invention.

According to this color image-forming apparatus, cleaning deficiency is eliminated so that a high-quality color image can be formed.

The above objects of the present invention are also achieved by a cleaning unit, including: a cleaning blade configured to come into contact with an image carrier and remove toner remaining thereon, the cleaning blade including: a vibration application member; a vibration member to which the vibration application member is attached; and an elastic blade member attached to the vibration member, wherein: the vibration member has first and second ends, the first end being fixed to a fixing member and the second end being directed to the image carrier so that an end of the blade member attached to the vibration member comes into contact with the image carrier; and the vibration application member expands and contracts in in-plane directions thereof to generate flexural vibration in the vibration member, the vibration application member being driven to expand and contract in the in-plane directions in a same phase.

The above objects of the present invention are also achieved by a cleaning unit, including: a cleaning blade configured to come into contact with an image carrier and remove toner remaining thereon, the cleaning blade including: a multilayer vibration application member; a vibration member to which the vibration application member is attached; and an elastic blade member attached to the vibration member, wherein the multilayer vibration application member is disposed between the vibration member and a fixing member disposed opposite the vibration member so as to couple the vibration member and the fixing member and cause an end of the blade member attached to the vibration member to come into contact with the image carrier, the multilayer vibration application member being driven to expand and contract in a same phase between the fixing member and the vibration member.

The above objects of the present invention are also achieved by a cleaning unit, including: a cleaning blade configured to come into contact with an image carrier and remove toner remaining thereon, the cleaning blade including: a vibration application member; a vibration member to which the vibration application member is attached; and an elastic blade member attached to the vibration member, wherein: the vibration member has a fixed first end and a second end directed to the image carrier so that an end of the blade member attached to the vibration member comes into contact with the image carrier; the vibration application member expands and contracts in in-plane directions thereof at a frequency in a frequency band above an audible range so as to cause flexural vibration in the vibration member; and a gap formed between the image carrier and the blade member by propagation of vibration generated by a drive member rotating the image carrier is smaller than an average particle size of the toner.

The above-described cleaning units are configured to transmit vibration efficiently to the end part of the blade member so that the vibration causes vibration to be transmitted to toner existing between the end of the blade member and the image carrier and the vibration of the end part of the blade member is transmitted to the image carrier. Vibration is also transmitted from the image carrier to the toner. These vibrations apply vibrations so that the nip part of the blade is shaped and moves differently from the conventional blade nip part. As a result, spherical toner or small-size toner is prevented from entering the blade nip part, so that cleaning deficiency can be eliminated with respect to the spherical toner and the small-size toner.

The above objects of the present invention are also achieved by an image-forming apparatus, including an image carrier and any of the above-described cleaning units.

The above objects of the present invention are also achieved by a process cartridge, including: an image carrier; a charging unit charging the image carrier; a developing unit performing development to form a toner image on the image carrier; a transfer unit transferring the toner image to a transfer medium; and any of the above-described cleaning units.

The above objects of the present invention are further achieved by a color image-forming apparatus, including at least two process cartridges, the process cartridges each being the process cartridge according to the present invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

Figure 7:
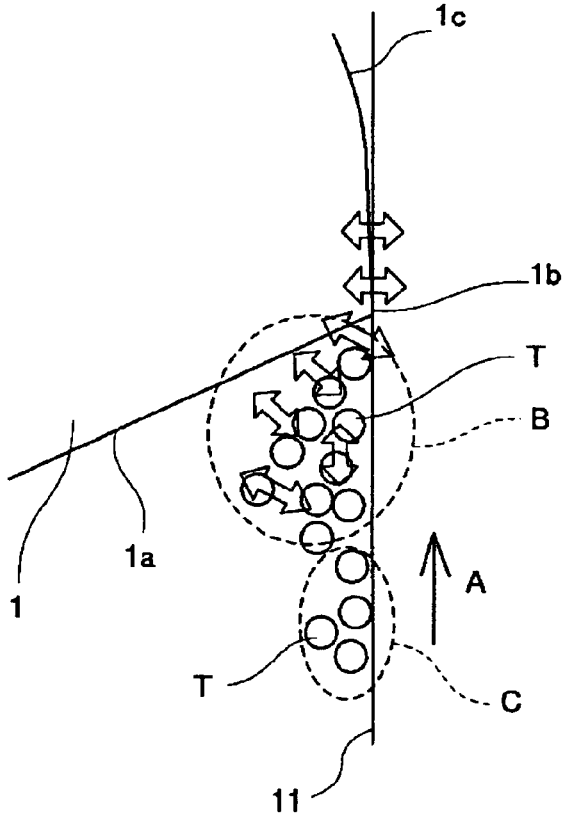
FIG. 7 is a diagram for illustrating the cleaning mechanism of a cleaning unit according to a first embodiment of the present invention.

First, a description is given, with reference to FIG. 7, of the mechanism of cleaning by a cleaning unit according to the present invention.

The cleaning unit is configured to effectively provide vibration to the end region of a blade member (hereinafter also referred to as a cleaning blade) 1. The vibration of the blade member 1 transmits vibrations to toner T existing between the end of the blade member 1 and an image carrier 11. Further, the vibration of the end region of the blade member 1 is transmitted to the image carrier 11, so that the image carrier 11 transmits vibrations to the toner T.

These applications of vibration vibrate the nip part of the blade member 1 so that the nip part is shaped and moves differently from that of the conventional cleaning unit using vibration application. As a result, spherical toner and toner of a small particle size (small-size toner) can be prevented from entering the blade nip part, thus making it possible to eliminate imperfect cleaning of the spherical toner and the small-size toner.

FIG. 7 is a diagram showing a state where the spherical toner T is actively vibrating because of vibrations transmitted from the vibrating blade member 1. The vibration of the toner T is indicated by open arrows in FIG. 7. This is a graphical representation of the result of observation by a high-speed video camera through a high power microscope. FIG. 7 shows that no turning occurs to a cut surface 1*a* of the blade member 1 and an edge part 1*b* of the cut surface 1*a* maintains its initial shape relative to the surface of the image carrier 11. The blade member 1 has a ventral surface 1*c* opposing the surface of the image carrier 11.

It was found out that at this point, particles of the spherical toner T existing in the vicinity of the cut surface 1*a* of the blade member 1 and the image carrier 11 vibrate over the range of a few particles (the range of a part indicated by arrow B).

In this state, the vibrating toner group in the vicinity of the nip part (the toner particles of the part B) functions as a barrier (a vibrating toner wall) so as to prevent the entry of subsequent particles of the toner T on the image carrier 11 (the toner particles of a part indicated by arrow C). As a result, no imperfect cleaning occurs to the spherical toner T, whose particles are substantially spherical in shape.

Figure 1:
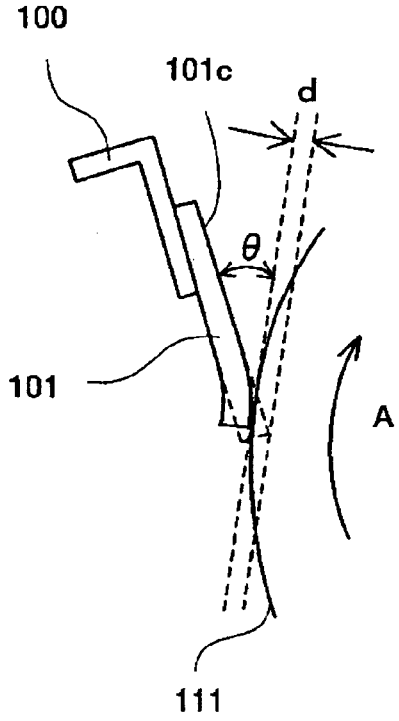
FIG.1 PRIOR ART
FIG. 1 is a diagram for illustrating a conventional cleaning blade.
Figure 2:
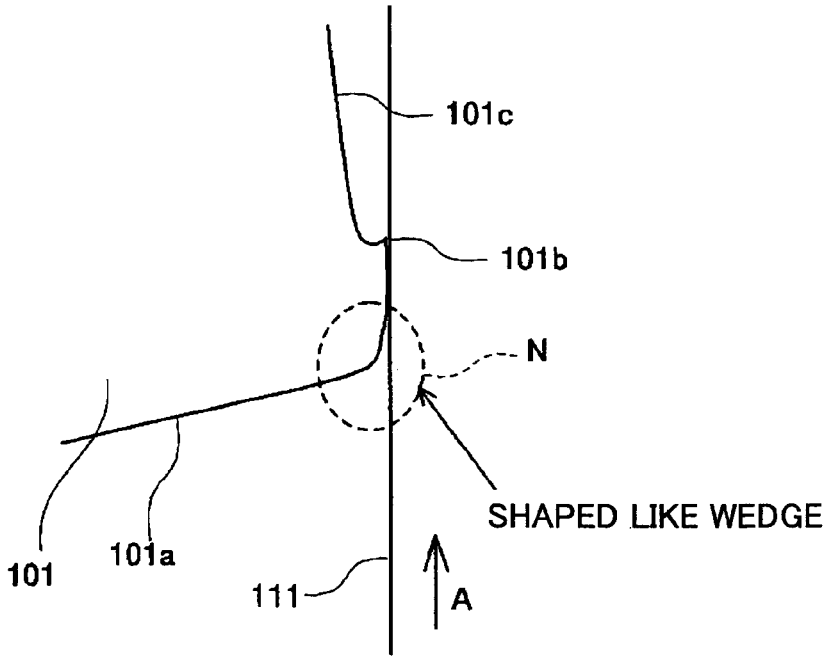
FIG.2 PRIOR ART
FIG. 2 is an enlarged view of part of the conventional cleaning blade, showing the state thereof when an image carrier is moving.
Figure 3:
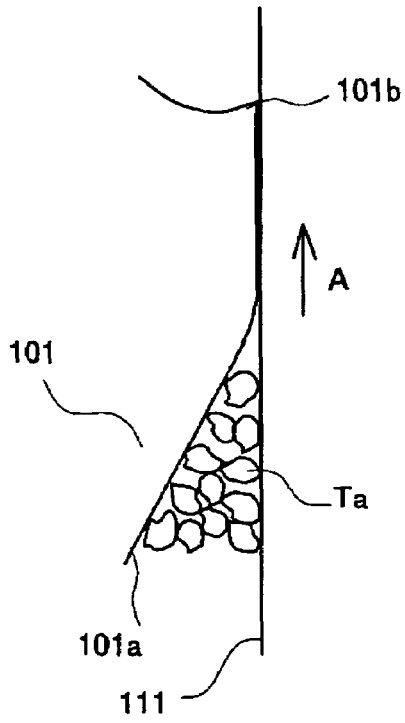
FIG.3 PRIOR ART
FIG. 3 is a diagram for illustrating the conventional mechanism of the cleaning of pulverized toner using the cleaning blade.
Figure 4:
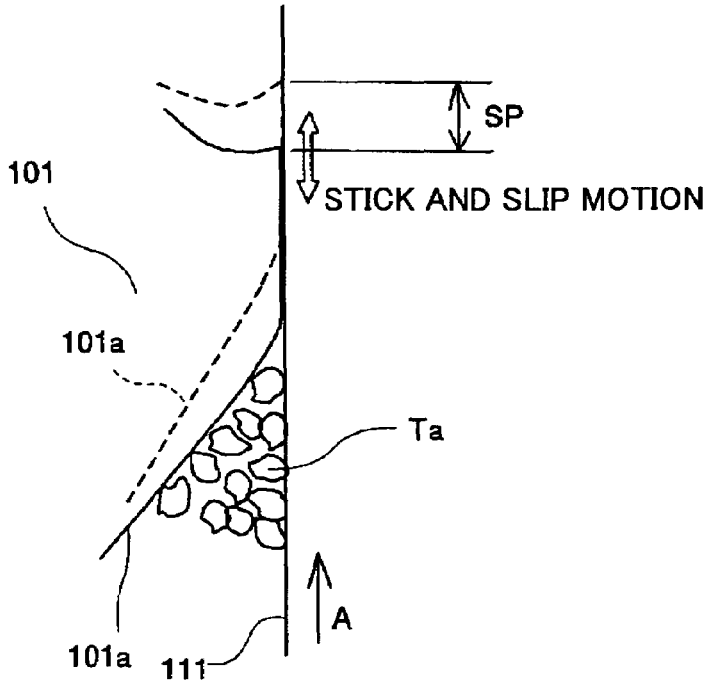
FIG.4 PRIOR ART
FIG. 4 is a diagram for illustrating stick and slip motion in the conventional mechanism of the cleaning of pulverized toner using the cleaning blade.
Figure 5:
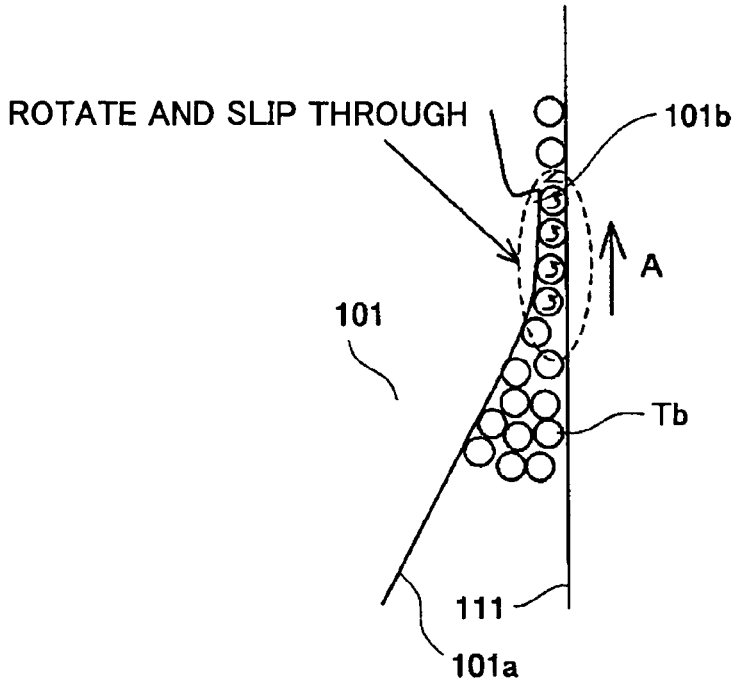
FIG.5 PRIOR ART
FIG. 5 is a diagram for illustrating the conventional mechanism of the generation of deficiency in the cleaning of spherical toner using the cleaning blade.
Figure 6:
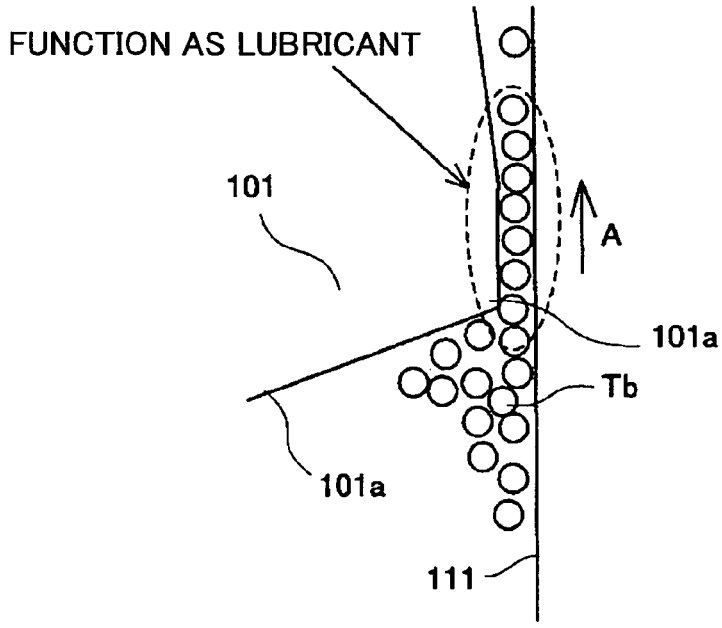
FIG.6 PRIOR ART
FIG. 6 is another diagram for illustrating the conventional mechanism showing the generation of deficiency in the cleaning of spherical toner using the cleaning blade.

It was discovered that at this point, there exists a condition for eliminating the phenomenon of the turning of the cut surface 1*a* of the blade member 1, which phenomenon occurs in the conventional cleaning method, as a result of the vibration of the blade member 1 and the transmission of vibration from the blade member 1 to the image carrier 11 reducing the friction between the blade member 1 and the image carrier 11. The "turning of a cut surface" refers to the state where the cut surface of a blade member deforms with the movement of an image carrier to come into contact with the surface thereof (the state of FIG. 2). Normally, the blade member is formed by cutting a formed elastic member in the direction of its thickness and finishing the edge of a cut piece into a sharp shape without burrs or chipping.

It was also discovered that by preventing the turning of the cut surface 1*a* of the blade member 1 from occurring, a stress from the blade member 1 to the image carrier 11 is reduced, so that the remarkable effect that a marked improvement is made in the durability of the blade member 1 and the image carrier 11 can be produced.

Thus, cleaning is performed by generating a contact part between the surface of the blade member 1 and the image carrier 11 by applying vibrations to the blade member 1. This contact part is referred to as a nip part. The blade member 1 to which vibration is applied may be referred to, as a whole, as a vibration application cleaning blade. The cleaning blade 1 is caused to vibrate by a vibration application part. Diligent study by the inventors of the present invention revealed that there is a correlation between the displacement of the cleaning blade 1 caused by vibration (vibration displacement) and the cleaning characteristic. The correlation is that the greater the vibration displacement of the cleaning blade 1, the better the cleaning characteristic.

It is not that the cleaning characteristic is always improved by the application of vibration by the vibration application part under any vibration application condition. The diligent study by the inventors of the present invention also revealed the phenomenon that no effect of vibration application is produced depending on vibration application conditions.

It is known that when the cleaning blade 1 and the image carrier 11 are assembled, the cleaning blade 1 and the image carrier 11 have natural vibration at a frequency different from their respective natural frequencies. This does not occur only to the blade 1 and the image carrier 11, but always occurs between two bodies. The natural frequency at this time is referred to as a resonance frequency.

As described above, a greater vibration application of the cleaning blade 1 caused by the vibration application means is better for the cleaning characteristic. It was discovered that in the case of securing vibration displacement with as little energy as possible, it is preferable to drive the vibration application part at a resonance frequency at the time of cleaning operation, that is, at the time of assembling the cleaning blade 1 and the image carrier 11. Therefore, according to an embodiment of the present invention, a piezoelectric element, which is easy to drive and control, may be employed as the vibration application part. The piezoelectric element is driven at a resonance frequency, so that a greater vibration displacement may be obtained by a small driving current.

The cleaning characteristic may be maintained by securing vibration displacement by employing a resonance frequency (a natural frequency determined by the blade 1 and the image carrier 11) as the driving frequency of the vibration application part, the resonance frequency changing over time at the time of cleaning operation or being determined to a certain extent at the time of assembling the blade 1 and the image carrier 11.

The driving frequency for driving the piezoelectric element is preferably out of the audible range. This is because if the driving frequency is within the audible range, noise unpleasant to human ears is generated during cleaning operation, which is not preferable. It is preferable that the piezoelectric element be driven, as much as possible, at a frequency out of the audible range, specifically, outside of the range of 20 Hz to 17 kHz. If an image-forming apparatus in which the cleaning unit is provided can be configured to insulate noise emanating from the vibration application cleaning blade 1, the driving frequency of the piezoelectric element may be within the audible range.

Figure 8:
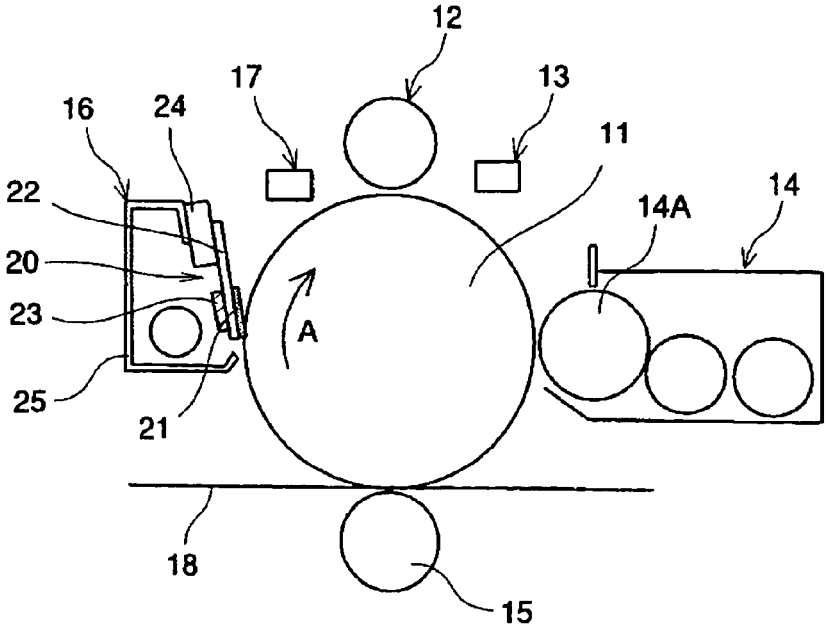
FIG. 8 is a schematic diagram showing an image-forming apparatus including the cleaning unit according to the first embodiment of the present invention.

Next, a description is given below, with reference to FIG. 8, of an image-forming apparatus including a cleaning unit 16 according to a first embodiment of the present invention. FIG. 8 is a schematic diagram showing the image-forming apparatus according to the first embodiment.

The image-forming apparatus includes the image carrier 11, a charging unit 12, an exposure unit 13, a development unit 14, a transfer unit 15, the cleaning unit 16, and a discharging unit 17. The charging unit 12, the exposure unit 13, the development unit 14, the transfer unit 15, the cleaning unit 16, and the discharging unit 17 are disposed around the image carrier 11. Further, the image-forming apparatus includes a fixing unit (not graphically represented) for fixing a toner image transferred from the image carrier 11 onto a transfer material 18.

The charging unit 12 is disposed at a predetermined distance from the surface of the image carrier 11. Alternatively, the charging unit 12 may be disposed in contact with the image carrier 11. The image carrier 11 is charged to a predetermined polarity and with a predetermined potential by applying a bias to the charging unit 12. The exposure unit 13 employs a laser diode (LD) or a light-emitting diode (LED) as a light-emitting element, and forms an electrostatic latent image on the image carrier 11 by emitting light thereonto based on image data.

The development unit 14 contains fixed magnet rollers and a freely rotatable developer carrier 14A. A developer is held on the developer carrier 14A. In this image-forming apparatus, a two-component developer formed of toner and a carrier is employed as the developer so that two-component magnetic brush development is performed. Other development methods such as single-component development using no carrier may be employed. A voltage is applied from a development bias power supply to the developer carrier 14A. The potential difference between the development bias and the potential of the electrostatic latent image formed on the surface of the image carrier 11 causes charged toner to adhere to the electrostatic latent image so that development is performed in a development area. As a result, a toner image is formed on the surface of the image carrier 11.

The transfer unit 15 comes into contact with the surface of the image carrier 11 with a predetermined pressing force so as to apply voltage thereto at the time of transferring the toner image. As a result, the transfer unit 15 transfers the toner image on the surface of the image carrier 11 onto the transfer material 18 in a transfer nip part between the image carrier 11 and the transfer unit 15. In this image-forming apparatus, the transfer of the toner image is performed using a transfer roller. Alternatively, the transfer of the toner image may also be performed using other transfer means such as a Colutron ion source or a transfer belt.

The cleaning unit 16, which is a cleaning unit according to the present invention, includes a blade member 21, a vibration member 22, and vibration application parts 23, which form a part referred to as a vibration application cleaning blade 20. The vibration application parts 23 are driven to vibrate the vibration member 22 so that a desired vibration is provided to the blade member (hereinafter referred to as the blade) 21, thereby removing residual toner on the surface of the image carrier 11.

The toner removed from the surface of the image carrier 11 by the cleaning unit 16 is conveyed by a toner conveying member to be stored in a waste toner bottle (not graphically represented) as waste toner. The stored toner is collected by a service person or conveyed to, for instance, the development unit 14 as recycled toner to be used for development.

The discharging unit 17 discharges the residual electric charge of the image carrier 11 from which the residual toner has been removed by the cleaning unit 16. The discharging unit 17 employs a discharger of a photo-discharge type using an LED.

Figure 9:
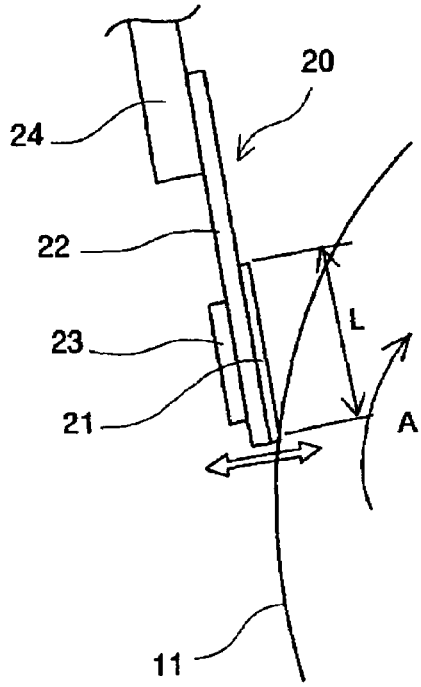
FIG. 9 is an enlarged view of part of a vibration application cleaning blade, showing a configuration of the cleaning unit according to the first embodiment of the present invention.
Figure 10:
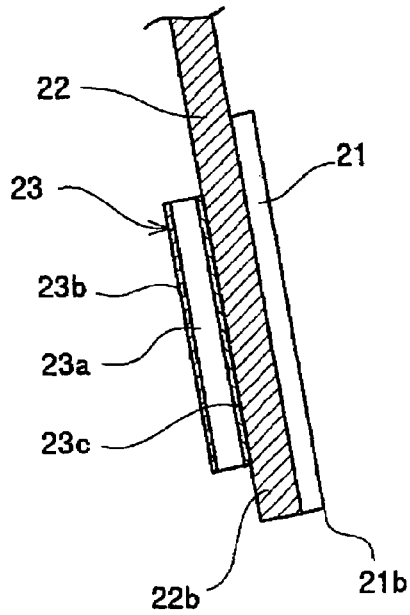
FIG. 10 is an enlarged view of a portion of the part of the vibration application cleaning blade of FIG. 9 according to the first embodiment of the present invention.
Figure 11:
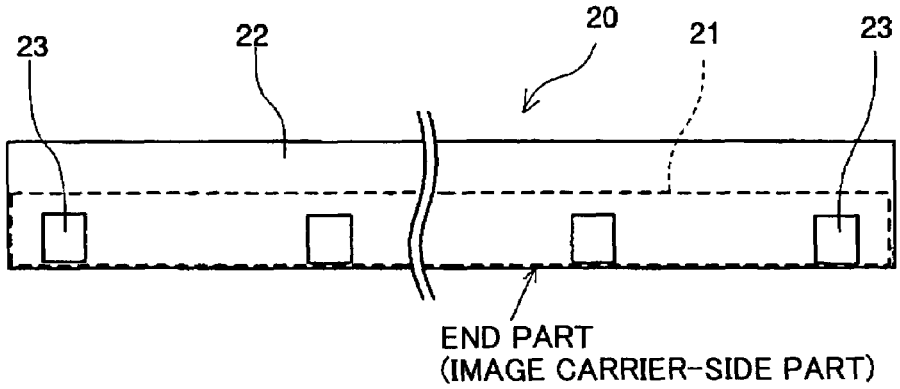
FIG. 11 is a front view of the vibration application cleaning blade according to the first embodiment of the present invention.
Figure 12:
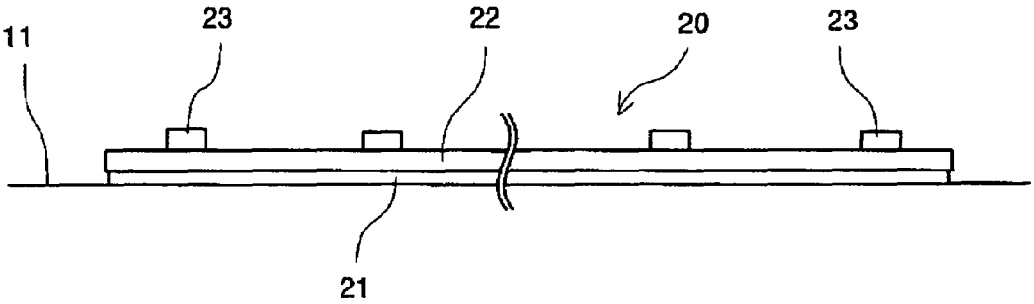
FIG. 12 is an end-side view of the vibration application cleaning blade according to the first embodiment of the present invention.

Next, a description is given, with reference to FIGS. 9 through 12, of the details of a configuration of the cleaning unit 16. FIG. 9 is an enlarged view of part of the vibration application cleaning blade 20 of the cleaning unit 16. FIG. 10 is an enlarged view of a portion of the part of the vibration application cleaning blade 20 shown in FIG. 9. FIG. 11 is a front view of the vibration application cleaning blade 20. FIG. 12 is an end-side view of the vibration application cleaning blade 20.

As described above, the vibration application cleaning blade 20 of the cleaning unit 16 includes the blade 21, the vibration member 22, and the vibration application parts 23. The blade 21 has substantially the same width as that of the image carrier 11 in its axial direction, and is attached to the end region of the vibration member 22. The vibration member 22 also has substantially the same width as that of the image carrier 11 in its axial direction. The vibration application parts 23 are attached to the vibration member 22.

The blade 21 is disposed to be in contact with the image carrier 11 in a leading direction with respect to (the direction counter to) a direction indicated by arrow A in FIG. 9 in which the image carrier 11 rotates.

The blade 21 is an elastic member whose material is, for instance, polyurethane rubber. The blade 21 may have a thickness of 50 to 2000 μm, preferably, 100 to 500 μm. If the thickness of the blade 21 is too small, the undulation of the surface of the image carrier 11 and the blade 21 itself makes it difficult to secure (an amount of) pressure by which the blade 21 is pressed against the image carrier 11. If the thickness of the blade 21 is too large, the blade 21 absorbs vibrations from the vibration member 22, thus preventing the vibrations from being sufficiently transmitted to the end part of the blade 21. As a result, the toner cleaning characteristic is reduced. If the blade 21 has a large thickness, vibration transmission efficiency may be increased by employing a hard member having a JIS-A hardness of 85 to 100° as the material of the blade 21.

A single layer or plural layers of other members may be interposed between the blade 21 and the vibration member 22 depending on a method of manufacturing a thin urethane blade. For instance, at the time of forming a thin urethane blade, the urethane blade is joined to and formed integrally with a ready-made film of resin having a higher hardness than urethane, such as PET. This increases the handling characteristic of cutting work for obtaining a sharp edge for the nip part of the blade 21. In this case, after performing cutting processing on the integration of PET and urethane, the PET side of the processed integration (the blade 21) is joined to the vibration member 22 so that the blade 21 is attached thereto.

The vibration member 22 is made of a vibratable material having a higher stiffness than the elastic blade 21, such as a metallic material such as a mild steel plate or a SUS plate or a molded resin member including carbon or glass fiber. One end of the vibration member 22 is fixed to a fixing part 24 (FIG. 9), and the blade 21 is attached to the other end of the vibration member 22 as a free end 22*b* (FIG. 10). Referring to FIG. 8, the fixing part 24 is fixed to a housing 25 of the cleaning unit 16.

The vibration member 22 also functions as the holder of the blade 21, and determines a pressing force to press the blade 21 against the image carrier 11 and a contact angle at which the blade 21 comes into contact with the image carrier 11. According to the conventional blade, the pressing force to press the blade nip part against the image carrier is provided by the restoring force of the elastic blade itself. On the other hand, according to the present invention, the blade 21 alone cannot secure the pressing force since the blade 21 is a thin member to increase the efficiency of transmitting vibration. Therefore, according to this embodiment, the vibration member 22 is configured to provide the blade 21 with a pressing force to press the blade 21 against the image carrier 11.

As a result, while using the thin elastic blade member 21, the efficiency of transmitting vibration can be increased, and a nip can be stably formed in accordance with the warp of the blade member 21 and the undulation of the surface of the image carrier 11. Accordingly, steady cleaning performance can be obtained.

The vibration application parts 23 provide vibration to the vibration member 22. In this embodiment, piezoelectric elements as electromechanical transducer elements, particularly, plate-like (single-plate) piezoelectric elements, are employed. The employment of the plate-like piezoelectric elements as the vibration application parts 23 makes it possible to configure a vibration application part that can obtain a displacement with ease at low cost.

Referring to FIGS. 11 and 12, the blade 21 and the vibration member 22 are elongated in the axial direction (along the width) of the image carrier 11, and the vibration application parts 23 are provided to the vibration member 22. The vibration application parts 23 may be replaced by a single vibration application part. However, by providing the vibration application parts 23 at intervals, the uniformity of vibration can be easily obtained along the width of the vibration member 22. The vibration application parts 23 may be replaced by a single elongated piezoelectric element. However, in the case of using a plate-like piezoelectric element, deflection (deformation) caused by the expansion and contraction of the piezoelectric element in its plate surface direction is utilized. Accordingly, it is preferable to dispose a plurality of plate-like piezoelectric elements at intervals.

The vibration application parts 23 are disposed close to the image carrier-side end of the vibration member 22. That is, the vibration application parts 23 are disposed at the free end 22*b* on the side opposite to the side to which the blade 21 is attached. However, depending on the configuration of the vibration member 22, the vibration application parts 23 may be attached to any positions between the fixed end of the vibration member 22 and the end (free end) of the blade 21 where the vibration application parts 23 can apply vibration to the vibration member 22.

Referring to FIG. 10, each of the single-plate piezoelectric elements forming the vibration application parts 23 includes a piezoelectric layer 23*a* formed of lead zirconate titanate and electrodes 23*b* and 23*c* formed of Ag. The electrodes 23*b* and 23*c* are formed on the first and second opposing surfaces, respectively, of the piezoelectric layer 23*a* by printing and burning, the second surface of the piezoelectric layer 23*a* being joined to the vibration member 22. When a voltage of 100 to 300 V is applied to the piezoelectric layer (piezoelectric element) 23*a* of 0.3 to 0.5 mm in thickness that has been polarized using the electrodes 23*b* and 23*c*, contractive deformation in the plate surface direction occurs in the piezoelectric layer 23*a*. As a result, deformation vibration that causes the vibration member 22 to deflect can be provided. This flexural vibration achieves good deformation efficiency when the piezoelectric elements (the vibration application parts 23) and the vibration member 22 have substantially the same stiffness. It is preferable to employ, for instance, a metal vibration member of 0.2 to 0.4 mm in thickness or a resin vibration member of 0.3 to 1.0 mm in thickness as the vibration member 22.

Figure 13:
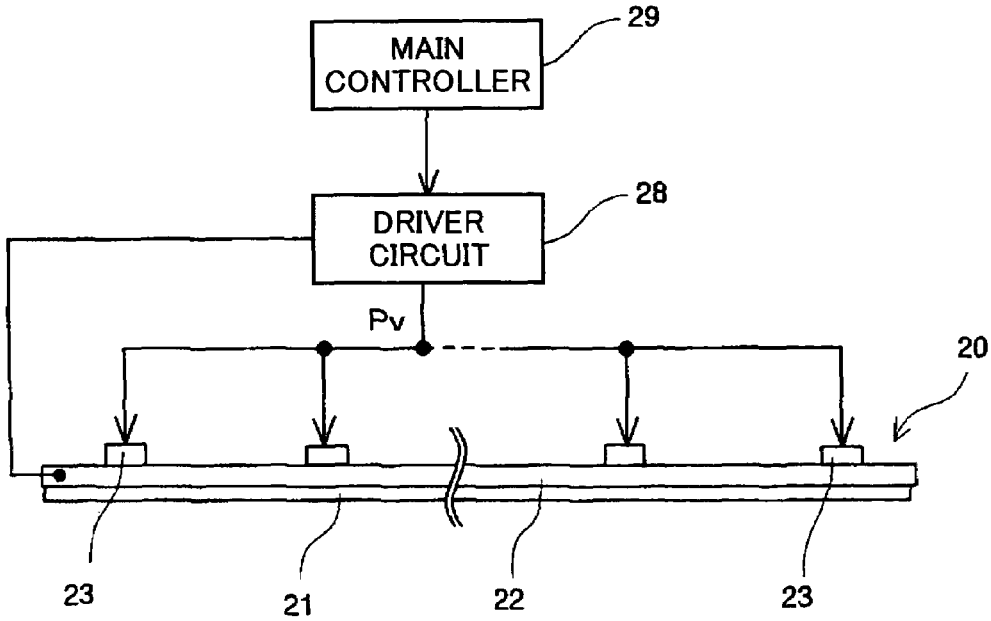
FIG. 13 is a diagram for illustrating a drive control system of the cleaning unit according to the first embodiment of the present invention.

Referring to FIG. 13, the cleaning unit 16 includes a driver circuit 28, which is a driving part according to this embodiment of the present invention, for applying a driving signal (driving waveform) Pv commonly to the piezoelectric elements forming the vibration application parts 23 of the vibration application blade 20.

In the case of providing the vibration application parts 23 along the width of the blade 21, the uniformity of vibration along the width of the blade 21 can be increased by driving the vibration application parts 23 by the common driver circuit 28.

Referring to FIG. 13, the driver circuit 28 is controlled by a main controller 29 of the image-forming apparatus so as to apply a desired driving frequency, that is, the driving signal Pv of a resonance frequency in this case, to the vibration application parts 23 with predetermined timing. According to this embodiment, the image carrier 11 is cleaned across its width by the single vibration application cleaning blade 20. Alternatively, a plurality of vibration application cleaning blades 20 may be provided to cover the width of the image carrier 11 in cleaning the image carrier 11. In this case, the dimension of each blade 21 and the dimension of each vibration member 22 in the axial direction of the image carrier 11 are determined by dividing the width of the image carrier 11 in its axial direction by the number of vibration application cleaning blades 20. In this case, it is also preferable to drive the vibration application parts 23 of the vibration application cleaning blades 20 by a common driver circuit.

According to this embodiment, a metallic member (conductive member) is employed as the vibration member 22, and the electrode 23*c* of each of the piezoelectric elements forming the vibration application parts 23 is put in direct contact with the vibration member 22 to be electrically connected thereto. Thereby, the electrodes 23*c* of the vibration application parts 23 are commonly connected via the vibration member 22. As a result, the application of a driving signal can be performed by a simple circuit structure. Each electrode 23*c* can be put in direct contact with the vibration member 22 easily by roughening the contact surface of the electrode 23*c* and joining the contact surface to the vibration member 22 by a thin adhesive layer. The electrode 23*c* may be joined to the vibration member 22 using a conductive adhesive agent.

According to the cleaning unit 16 having the above-described configuration, the driving signal Pv, whose driving frequency is the resonance frequency determined by the correlation between the vibration application cleaning blade 20 and the image carrier 11, is supplied from the driver circuit 28 to the vibration application parts 23, so that deflection (deformation) occurs in the piezoelectric elements forming the vibration application parts 23. As a result, the vibration member 22 vibrates, and the vibration of the vibration member 22 causes the blade 21 to vibrate at the resonance frequency.

Thus, the vibration application parts 23 are driven at the resonance frequency, and the vibration member 22 provides vibration to the blade 21 and a pressing force to press the blade 21 against the image carrier 11. According to this configuration, a vibration displacement can be secured, and a high cleaning characteristic by the vibration application cleaning blade 20 with respect to residual toner on the surface of the image carrier 11 can be ensured. In this case, the use of piezoelectric elements as the vibration application parts 23 enables the vibration application parts 23 to be driven at a resonance frequency with ease.

Next, a detailed description is given of this embodiment.

Method of driving the vibration application cleaning blade 20.

A driving waveform (driving signal) of a set voltage value for causing a certain vibration was applied from a drive power supply to the piezoelectric elements that are the vibration application parts 23. The drive power supply was experimentally formed by a function generator for generating a pulse signal. The signal generated from the function generator was amplified by a power supply to be applied to the piezoelectric elements. In order to observe the voltage actually applied to the piezoelectric elements, the amplified voltage was caused to branch to be monitored by an oscilloscope.

In the case of arranging a plurality of piezoelectric elements and causing the piezoelectric elements to operate and in the case of arranging a plurality of sets of image carriers and cleaning blades for a plurality of colors as in a tandem image-forming apparatus, a plurality of sets of function generators and power supplies may be prepared. Alternatively, a voltage from the same power supply may be caused to branch so as to be applied to the piezoelectric elements. However, if there are a large number of branches, it is preferable that the power supply be able to output sufficient power.

In the above-described image-forming apparatus or a below-described process cartridge according to this embodiment, a power supply that takes up less space is preferable. Accordingly, the driver (driver circuit 28) integrating a function generator and a power supply is employed to drive the vibration application parts 23. At this point, the main controller 29 controlling the image-forming apparatus and the process cartridge changes the conditions of driving by the driver in accordance with situations or synchronizes the driving of the vibration application parts 23 with an operation sequence at the time of forming an image or forming no image so that the driving of the vibration application parts 23 can be controlled by the main controller 29.

Next, a description is given of the toner, or developing particles, used in this embodiment of the present invention.

Toner

In this embodiment, polymerized toner having high sphericity for achieving high image quality and made by dissolution suspension is employed. The characteristics of the toner are as follows.

Sphericity: 0.980

Weight-average particle size: 5.41 μm

Carrier: a silicon-coated carrier of a weight-average particle size of 50 μm (of a magnetite core)

Next, a description is given of the circularity of toner. In order for an image-forming apparatus using spherical toner to form a high-quality image, it is preferable that the toner (particles) have a specific shape. If the toner has an average circularity lower than 0.95 so that the toner particles have irregular shapes far removed from a spherical shape, good transferability and a high-quality image without dust cannot be obtained. Accordingly, it is preferable that the spherical toner has a circularity higher than or equal to 0.95.

Figure 14:
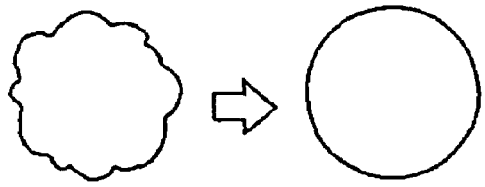
FIG. 14 is a diagram for illustrating toner circularity according to the first embodiment of the present invention.

The particle shape of the toner may be suitably measured by a method using an optical detection zone according to which a suspension including particles is caused to pass through the detection zone of an image-capturing part on a flat plate so that a particle image is detected by a CCD camera to be analyzed. Toner whose average circularity is higher than or equal to 0.95 has been found to be effective in forming a high-definition image having appropriate density reproducibility. The average circularity is the average of the circularities of particles. Referring to FIG. 14, which graphically represents the definition of the circularity, the circularity is a value obtained by dividing the circumference L2 of an equivalent circle having the same projected area S as an actual particle by the circumference L1 of the actual particle.

It is more preferable that the toner has an average circularity of 0.960 to 0.998. This value may be measured as an average circularity by Flow Particle Image Analyzer FPIA-2100 (product name; manufactured by Sysmex Corporation). A specific measurement method is as follows. In 100 to 150 ml of water from which solid impurities have been removed in a container, 0.1 to 0.5 ml of a surface active agent, preferably alkylbenzene sulfonate, is added as a dispersant, and then, 0.1 to 0.5 g of a test portion (sample) is further added. The suspension in which the sample is dispersed is subjected to dispersion processing for about 1 to 3 minutes in an ultrasonic dispersion apparatus so that a dispersion solution concentration of 3,000 to 10,000/μl is obtained. Then, the shapes and the distribution of the toner particles are measured by the above-described analyzer. As a result, the circularity of the toner is obtained.

The particle size of toner may be measured as follows. The average particle size and the particle size distribution of the toner were subjected to data analysis using Multisizer 3 Coulter Counter (product name; manufactured by Beckman Coulter, Inc.), connected to an IBM personal computer, and software used exclusively for the apparatus (manufactured by Beckman Coulter, Inc.). A Kd value was set using standard particles of 10 μm, and an aperture current was set according to automatic setting. Using first-grade sodium chloride as an electrolyte, 1% NaCl aqueous solution was prepared. ISOTON-II (product name; manufactured by Coulter Scientific Japan) may be employed as an electrolyte.

As a measurement method, in 100 to 150 ml of the above-described electrolyte aqueous solution, 0.1 to 5 ml of a surface active agent, preferably alkylbenzene sulfonate, was added as a dispersant, and then, 2 to 20 mg of a test portion (sample) was further added. The electrolyte in which the sample was suspended was subjected to dispersion processing for about 1 to 3 minutes in an ultrasonic dispersion apparatus. Then, using a 100 μm aperture tube, 50,000 counts of toner particles greater than or equal to 2 μm were measured so that a weight-average particle size was obtained.

Next, a description is given of a method of manufacturing polymerized, spherical toner.

As a method of manufacturing the above-described toner having a circularity of 0.960 to 0.998, a manufacturing method using wet granulation, such as suspension polymerization, dispersion polymerization, emulsion aggregation, interfacial polymerization, dissolution suspension, or emulsification by phase inversion may be employed. In the case of toner formed by pulverizing and classifying a molten kneaded substance, the toner can be manufactured to have high circularity by heat treatment. This, however, is not preferable in terms of energy efficiency.

Among the above-described methods of wet granulation, suspension polymerization and dispersion polymerization are excellent in that toner having high circularity can be stably obtained and that a sharp particle size distribution can be obtained. Further, suspension polymerization and dispersion polymerization are also excellent in terms of control of toner charging. Dissolution suspension is excellent in that a polyester resin, which is advantageous in the low temperature fixability of toner, is employable. A detailed description is given below of suspension polymerization, dispersion polymerization, and dissolution suspension.

Suspension Polymerization

A dispersion stabilizer and a colorant, and further, a crosslinking agents a charge control agent, and a release agent as required, are dispersed evenly with respect to a below-described particular monomer by a ball mill. Thereafter, a polymerization initiator is added so that a monomer phase is obtained. The monomer phase and an aqueous dispersing medium phase that has been prepared by stirring are put in a mixing vessel, and are stirred by a homogenizer. A resultant suspension is heated after nitrogen substitution, so that polymerization reaction is completed. As a result, colored resin particles are obtained, and by cleaning and drying the colored resin particles, toner particles of high circularity are obtained.

The polymerizable monomer employed in suspension polymerization has a vinyl group. Specific examples of such a polymerizable monomer include styrene and its derivatives such as o-methylstyrene, m-methylstyrene, p-methylstyrene, 2,4-dimethylstyrene, butylstyrene, and octylstyrene, of which a styrene monomer is the most suitable.

Other vinyl monomers, such as: ethylene-based unsaturated monoolefins including propylene, butylene, and isobutylene; vinyl halides including vinyl chloride, vinylidene chloride, vinyl bromide, and vinyl fluoride; vinyl esters including vinyl acetate, propionic acid vinyl, benzoeacid vinyl, and vinyl butyrate; α-methylene aliphatic monocarboxylic acid esters including methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, α-methyl chloroacrylate, methyl methacrylate, ethyl methacrylate, propyl methacrylate, n-butyl methacrylate, isopropyl methacrylate, n-octyl methacrylate, dodecyl methacrylate, 2-ethylhexyl methacrylate, stearyl methacrylate, phenyl methacrylate, and diethylaminoethyl methacrylate; acrylic or methacrylic acid derivatives including acrylonitrile, methacrylonitrile, and acrylamide; vinyl ethers including vinyl methyl ether and vinyl isobutyl ether; vinyl ketones including vinyl methyl ketone, vinyl hexyl ketone, and methyl isopropenyl ketone; N-vinyl compounds including N-vinylpyrrole, N-vinylcarbazole, N-vinylindole, and N-vinylpyrrolidone; and vinylnaphthalene, may be employed alone or in mixture.

According to suspension polymerization, a crosslinking agent may exist in a monomer composition in order to generate a crosslinked polymer. Examples of the crosslinking agent include divinylbenzene, divinylnaphthalene, polyethylene glycol diacrylate, diethylene glycol diacrylate, triethylene glycol diacrylate, 1,3-butylene glycol diacrylate, 1,6-hexane glycol dimethacrylate, neopentyl glycol diacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolmethane tetraacrylate, dibromoneopentylglycol dimethacrylate, and diallyl phthalate.

If the crosslinking agent is used in excessive amount, toner becomes less meltable in heat, consequently having poor heat fixability and heat pressure fixability. On the other hand, if the crosslinking agent is used in too little amount, characteristics required as toner, such as blocking resistance and durability, degrade. As a result, in heat roller fixing, there occurs cold offset, a phenomenon where a portion of toner is not fixed completely to paper, but adheres to the surface of a roller so as to be transferred to the next sheet of paper. Accordingly, the amount of a crosslinking agent to be employed is 0.001 to 15 parts by weight, preferably 0.1 to 10 parts by weight, per 100 parts by weight of a polymerizable monomer.

Dispersion stabilizers employable in suspension polymerization are as follows: water soluble polymers including polyvinyl alcohol, starch, methyl cellulose, carboxymethyl cellulose, hydroxymethyl cellulose, sodium polyacrylate, and poly(sodium methacrylate); barium sulfate; calcium sulfate; barium carbonate; magnesium carbonate; calcium phosphate; talc; clay; diatomite; and metallic oxide powder. The amount of a dispersion stabilizer to be employed is preferably in the range of 0.1 to 10 weight percent to water.

According to suspension polymerization, a polymerization initiator may be added to a dispersion including a monomer composition after granulation. However, in order to provide the polymerization initiator evenly to the individual particles of the monomer composition, it is preferable that the polymerization initiator be included in the monomer composition before granulation. Examples of such a polymerization initiator include: azo- or diazo-polymerization initiators including 2,2'-azobis(2,4-dimethylvaleronitrile), 2,2'-azobis(isobutylonitrile), 1,1'-azobis(cyclohexane-1-carbonitrile), 2,2'-azobis(4-methoxy-2,4-dimethylvaleronitrile), and azobisbutyronitrile; and peroxide polymerization initiators including benzoyl peroxide, methyl ethyl ketone peroxide, isopropyl peroxide, 2,4-dichlorobenzoyl peroxide, and lauryl peroxide.

According to suspension polymerization, a type of magnetic toner including a magnetic substance is formable. Magnetic particles may be added to a monomer composition to form magnetic toner. Magnetic substances employable in the present invention include powder of ferromagnetic metals such as iron, cobalt, and nickel and powder of magnetite, hematite, and ferrite alloys and compounds.

Magnetic particles of 0.05 to 5 μm, preferably 0.1 to 1 μm, in diameter are employed. In the case of forming small-size toner, it is preferable to use magnetic particles of 0.8 μm or less in diameter. It is preferable to include 10 to 60 parts by weight of these particles in 100 parts by weight of a monomer composition. These magnetic particles may be processed by a coupling agent such as a silane coupling agent or a titanium coupling agent or suitable reactive resin. In this case, depending on the area of the surfaces of the magnetic particles or the density of hydroxyl groups existing thereon, normally, sufficient dispersion into polymerizable monomers can be obtained without adversely affecting the physical properties of toner by processing with 5 parts by weight or less, preferably 0.1 to 3 parts by weight, of a coupling agent per 100 parts by weight of the magnetic particles.

Dispersion Polymerization

To a hydrophilic organic liquid, a polymer dispersant soluble in the hydrophilic organic liquid is added, and one or more kinds of vinyl monomers that are soluble in the hydrophilic organic liquid but generate a polymer that swells or hardly dissolves in the hydrophilic organic liquid are further added, so that polymerization is performed. As a result, toner is manufactured. Further, a reaction that causes the vinyl monomers to propagate in advance in the above-described system using polymer particles having a particle size smaller than a desired particle size and having a narrow particle size distribution is also included. The monomers used in the propagation reaction may be equal to or different from those from which the seed particles are produced, but the resultant polymer should not dissolve in hydrophilic organic liquid.

Typical examples of the hydrophilic organic liquid as a diluent diluting a monomer employed at the time of the formation and the propagation reaction of seed particles include: alcohols such as methyl alcohol, ethyl alcohol, modified ethyl alcohol, isopropyl alcohol, n-butyl alcohol, isobutyl alcohol, t-butyl alcohol, s-butyl alcohol, t-amyl alcohol, 3-pentanol, octyl alcohol, benzyl alcohol, cyclohexanol, furfuryl alcohol, tetrahydrofurfuryl alcohol, ethylene glycol, glycerine, and diethylene glycol; and ether alcohols such as methylcellosolve, cellosolve, isopropylcellosolve, butylcellosolve, ethylene glycol monomethyl ether, ethylene glycol monoethyl ether, diethylene glycol monomethyl ether, and diethylene glycol monoethyl ether.

These organic liquids may be employed alone or two or more thereof may be employed as a mixture. The above-described alcohols and ether alcohols may be used in combination with organic liquid other than alcohol and ether alcohol. As a result, by performing polymerization while varying the SP (solubility parameter) value of organic liquid under the condition that the organic liquid prevents polymer particles to be generated from having solubility, it is possible to control the size of generated particles, cause seed particles to condense, and prevent new particles from being generated.

Examples of the organic liquid used in combination in this case include: hydrocarbons such as hexane, octane, petroleum ether, cyclohexane, benzene, toluene, and xylene; halogenated hydrocarbons such as carbon tetrachloride, trichloroethylene, and tetrabromoethane; ethers such as ethyl ether, dimethyl glycol, siloxane, and tetrahydrofuran; acetals such as methylal and diethylacetal; ketones such as acetone, methyl ethyl ketone, methyl isobutyl ketone, and cyclohexane; esters such as butyl formate, butyl acetate, ethyl propionate, and cellosolve acetate; acids such as formic acid, acetic acid, and propionic acid; sulfur or nitrogen-containing organic compounds, such as nitropropene, nitrobenzene, dimethylamine, monoethanolamine, pyridine, dimethylsulfoxide, and dimethylformamide; and water.

The average particle size, the particle size distribution, and the drying condition of polymer particles to be generated may be controlled by changing types and compositions of mixture solvents at the initial stage, in the middle, and at the end stage of polymerization.

Suitable examples of a polymer dispersant employed at the time of producing seed particles or propagated particles include: homopolymers or copolymers of acids such as acrylic acid, methacrylic acid, α-cyanoacrylic acid, α-cyanomethacrylic acid, itaconic acid, crotonic acid, fumaric acid, maleic acid, and maleic anhydride, acrylic monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate ester, diethyleneglycol monomethacrylate ester, glycerin monoacrylate ester, glycerin monomethacrylate ester, N-methylolacrylamide, and N-methylolmethacrylamide, vinyl alcohols or ethers from materials containing a vinyl alcohol such as vinyl methyl ether, vinyl ethyl ether, vinyl propyl ether, and vinyl propyl ether, esters from vinyl alcohol and a compound having a carboxyl group such as vinyl acetate, vinyl propionate, and vinyl butyrate, acrylamide, methacrylamide, diacetone acrylamide, and their methylol compounds, acid chlorides such as acryloyl chloride and methacryloyl chloride, and those having a nitrogen atom or a heterocyclic ring containing the atom such as vinylpyridine, vinylpyrrolidone, vinylimidazole, and ethyleneimine; copolymers of those based on polyoxyethylene such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester, celluloses such as methylcellulose, hydroxyethylcellulose, and hydroxypropylcellulose, or the above-described hydrophilic monomers, and those containing a benzene ring and their derivatives such as styrene, α-methylstyrene, and vinyltoluene, or acrylic or methacrylic acid derivatives such as acrylonitrile, methacrylonitrile, and acrylamide; and copolymers of the above-described copolymers and crosslinkable monomers such as ethyleneglycol dimethacrylate, diethyleneglycol dimethacrylate, allyl methacrylate, and divinylbenzene.

These polymer dispersants are suitably selected based on hydrophilic organic liquid to be used, a desired type of polymer particles, and whether to produce seed particles or propagated particles. Particularly, in terms of mainly preventing three-dimensional condensation of polymer particles, polymer dispersants having high affinity and adsorption to the surfaces of the polymer particles and having high affinity to and high solubility in the hydrophilic organic liquid are selected. Further, in order to increase three-dimensional mutual repulsion among particles, polymer dispersants having molecular chains of a certain length, preferably, those having a molecular weight of 10,000 or over, are selected. However, an excessively high molecular weight causes a remarkable increase in the liquid viscosity of the dispersed system, thus degrading its operability and stirring characteristic, and varies the probability of deposition on the surfaces of generated polymers. Further, it is effective in stabilizing polymer particles to be produced to cause part of the monomers of the polymer dispersant to coexist in the monomers composing the polymer particles to be produced.

Further, the stability and the particle size distribution of polymer particles to be produced can be further improved by using any of the above-described polymer dispersants in combination with any of: inorganic compound fine powder of metals such as cobalt, iron, nickel, aluminum, copper, tin, lead, and magnesium and their alloys (preferably less than or equal to 1 μm in particle size) and oxides such as iron oxide, copper oxide, nickel oxide, zinc oxide, titanium oxide, and silicon oxide; anionic surfactants such as salts of higher alcohol sulfate ester, alkylbenzene sulfonate salts, α-olefin sulfonate salts, and phosphate ester; amine salt-type cationic surfactants such as alkylamine salts, derivatives from an aminoalcohol and a fatty acid, derivatives from a polyamine and a fatty acid, and imidazoline; quaternary ammonium salt-type cationic surfactants such as alkyltrimethylammonium salts, dialkyldimethylammonium salts, alkyldimethylbenzylammoinium salts, pyridinium salts, alkylisoquinolinium salts, and benzethonium chloride; nonionic surfactants such as fatty amide derivatives and multivalent alcohol derivatives; and amino acid or betaine amphoteric surfactants such as dodecyldi(aminoethyl)glycine and di(octylaminoethyl)glycine.

Generally, the amount of a polymer dispersant to be used at the time of producing seed particles, which differs depending on the type of a polymerizable monomer for producing desired polymer particles, is 0.1 to 10 weight percent, preferably, 1 to 5 weight percent, to hydrophilic organic liquid. When the concentration of a polymer dispersion stabilizer is low, polymer particles of a relatively large size are produced. When the concentration is high, polymer particles of a small size are produced. Using the polymer dispersant in excess of 10 weight percent has little effect in producing polymer particles of a small size.

The above-described vinyl monomers are soluble in hydrophilic organic liquid. Examples of the vinyl monomers include: styrenes such as styrene, o-methylstyrene, m-methylstyrene, p-methylstyrene, α-methylstyrene, p-ethylethylene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene; acrylate esters and their derivatives such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, and methyl α-chloroacrylate; monocarboxylic acid esters of an α-methyl fatty acid such as methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate; acrylic or methacrylic acid derivatives such as acrylonitrile, methacrylonitrile, and acrylamide; and vinyl halides such as vinyl chloride, vinylidene chloride, vinyl bromide, and vinyl fluoride. These vinyl monomers may be employed alone or in mixture. Further, a mixture of 50 weight percent or more of any of these vinyl monomers and a monomer copolymerizable therewith is also employable.

The polymer according to the present invention may be polymerized in the presence of a so-called crosslinking agent having two or more polymerizable double bonds in order to increase offset resistance. Preferably employed crosslinking agents include all divinyl compounds and compounds having three or more vinyl groups. The divinyl compounds include: aromatic divinyl compounds that are divinylbenzene, divinylnaphthalene, and their derivatives; diethylenic carboxylic acid esters such as ethylene glycol dimethacrylate, diethylene glycol methacrylate, triethylene glycol methacrylate, trimethylolpropane triacrylate, allyl methacrylate, tert-butylaminoethyl methacrylate, tetraethylene glycol dimethacrylate, and 1,3-butanediol dimethacrylate; N,N-divnylaniline; divinyl ether; divinyl sulfide; and divinyl sulfone.

In the case of successively causing propagation polymerization reaction using seed particles thus crosslinked, propagating polymer particles are internally crosslinked. On the other hand, in the case of including the crosslinking agent in a vinyl monomer solution used for propagation reaction, a polymer whose particles have hardened surfaces is obtained.

Further, in order to control the average molecular weight, polymerization may be performed in the presence of a compound having a great chain transfer constant, such as a low molecular compound having a mercapto group, carbon tetrachloride, or carbon tetrabromide.

Examples of an initiator for polymerizing the monomers include: azo-polymerization initiators such as 2,2'-azobis (isobutylonitrile) and 2,2'-azobis(2,4-dimethylvaleronitrile); peroxide polymerization initiators such as lauryl peroxide, benzoyl peroxide, and t-butyl peroctoate; persulfate polymerization initiators such as potassium persulfate; and systems using any of the above-described polymerization initiators in combination with sodium thiosulfate or amine. The concentration of the polymerization initiator is preferably 0.1 to 10 parts by weight per 100 parts by weight of a vinyl monomer.

As polymerization conditions for obtaining seed particles, the concentrations and the compounding ratio of a polymer dispersant and a vinyl monomer in hydrophilic organic liquid are determined in accordance with the desired average particle size and the desired particle size distribution of polymer particles. Generally, the concentration of the polymer dispersant is set to a high value to reduce the average particle size, and is set to a low value to increase the average particle size. On the other hand, the concentration of the vinyl monomer is set to a low value to obtain a sharp particle size distribution, and is set to a high value if particle sizes may have a wide distribution.

Particles are produced by polymerization as follows. A polymer dispersion stabilizer is dissolved completely in hydrophilic organic liquid. Thereafter, one or more kinds of vinyl monomers, a polymerization initiator, and if necessary, inorganic fine powder, a surfactant, a dye, and a pigment are added to the liquid. The liquid is stirred by normal stirring of 30 to 300 rpm, preferably, at as low speed as possible, using mixing impellers of a turbine type rather than a paddle type, so that the liquid flows uniformly in a vessel, while heat treatment is applied at a temperature corresponding to the polymerization rate of the employed polymerization initiator, so that polymerization is performed.

Temperature at the initial stage of polymerization exerts a great influence on the type of particles to be produced. Accordingly, it is preferable that after adding the monomers, temperature be raised to a polymerization temperature and the polymerization initiator be added, being dissolved in a small amount of solvent. At the time of polymerization, it is necessary to sufficiently purge oxygen from the air inside the reaction vessel by an inert gas such as a nitrogen gas or an argon gas. If the purge of oxygen is insufficient, fine particles are prone to be produced. In order to perform polymerization in the range of high polymerization rates, a polymerization period of 5 to 40 hours is required. The rate of polymerization can be increased by stopping polymerization in the state of a desired particle size and particle size distribution, successively adding a polymerization initiator, or causing reaction under high pressure.

After the polymerization is completed, obtained polymer particles may be employed directly in a dying process. Alternatively, the obtained polymer particles may be collected as polymer slurry and dyed after removing unnecessary fine particles, residual monomers, and the polymer dispersion stabilizer therefrom by, for instance, sedimentation, centrifugal separation, or decantation. With the dispersion stabilizer, however, the stability of dyeing is higher so that unnecessary condensation can be prevented.

Dyeing in dispersion polymerization is as follows. Resin particles are dispersed in an organic solvent that does not allow the resin particles to be dissolved therein. Before or after the dispersion, a dye is dissolved in the solvent to permeate into the resin particles so that the resin particles are dyed. Thereafter, the organic solvent is removed so that dyed toner is manufactured. In this method, letting the solubility of the dye to the organic solvent and the solubility of the dye to the resin particles be D1 and D2, respectively, such a dye is selected and employed that causes the relationship between D1 and D2 to be $D1/D2 \leqq 0.5$. As a result, toner in which the dye permeates (dispersed) deeply into the resin particles can be manufactured with efficiency.

According to the present invention, solubility is defined as measured at a temperature of 25° C. The solubility of a dye into resin is defined the same as the solubility of a dye into a solvent, and signifies a maximum amount of dye that can be contained in the resin in a compatible state. The state of solution or the state of deposition of the dye can be observed easily with a microscope. The solubility of a dye to resin may be understood by indirect observation instead of the above-described direct observation. According to indirect observation, liquid having a solubility coefficient approximating that of the resin, that is, a solvent in which the resin is well dissolved, may be employed, and the solubility of the dye to the solvent may be defined as the solubility of the dye to the resin.

The dye employed for dyeing is required to satisfy $D1/D2 \leqq 0.5$ as described above, preferably, $D1/D2 \leqq 0.2$. No particular requirements other than the above-described solution characteristic (solubility) need be satisfied by the dye. However, water-soluble dyes such as a cationic dye and an anionic dye may be subject to great environmental variation, thus reducing the electric resistance, and accordingly, the rate of transfer of toner. Therefore, it is preferable to employ a vat dye, a disperse dye, or an oil-soluble dye. Of those, the oil-soluble dye is particularly preferable. Further, a plurality of kinds of dyes may be used in combination in accordance with a desired color tone.

The (weight) ratio of a dye to resin particles to be dyed is selected as desired based on the degree of coloring. Normally, it is preferable to employ 1 to 50 parts by weight of a dye per one part by weight of resin particles. For instance, in the case of using alcohol having a high SP value, such as methanol or ethanol, as a dyeing solvent, and using a styrene-acrylic resin having an SP value of approximately 9 as resin particles, employable dyes are as follows:

CI SOLVENT YELLOW (6, 9, 17, 31, 35, 1, 102, 103, 105)

CI SOLVENT ORANGE (2, 7, 13, 14, 66)

CI SOLVENT RED (5, 16, 17, 18, 19, 22, 23, 143, 145, 146, 149, 150, 151, 157, 158)

CI SOLVENT VIOLET (31, 32, 33, 37)

CI SOLVENT BLUE (22, 63, 78, 83-86, 91, 94, 95, 104)

CI SOLVENT GREEN (24, 25)

CI SOLVENT BROWN (3, 9)

Commercially available dyes that are employable include: SOT dyes Yellow-1, 3, 4, Orange-1, 2, 3, Scarlet-1, Red-1, 2, 3, Brown-2, Blue-1, 2, Violet-1, Green-1, 2, 3, and Black-1, 4, 6, 8 manufactured by HODOGAYA CHEMICAL CO., LTD.; Sudan dyes Yellow-140, 150, Orange-220, Red-290, 380, 460, and Blue-670 manufactured by BASF; Yellow-3G, F, H2G, HG, HC, HL, Orange-HS, G, Red-GG, S, HS, A, K, H5B, Violet-D, Blue-J, G, N, K, P, H3G, 4G, Green-C, and Brown-A manufactured by MITSUBISHI CHEMICAL CORPORATION; OIL colors Yellow-3G, GG-S, #105, Orange-PS, PR, #201, Scarlet-#308, Red-5B, Brown-GR, #416, Green-BG, #502, Blue-BOS, HN, Black-HBB, #803, EE, EX manufactured by Orient Chemical Industries, Ltd.; Sumiplast Blue GP, OR, Red FB, 3B, and Yellow FL7G, GC manufactured by Sumitomo Chemical Co., Ltd.; and Kayaron, Polyester Black EX-SH3, and Blue A-2R of Kayaset Red-B manufactured by NIPPON KAYAKU CO., LTD. The dye is suitably selected based on the combination of resin particles and a solvent to be used at the time of dyeing, and is not limited to the above-described examples.

A dyeing organic solvent to be employed to dye resin particles with a dye prevents the resin particles from being dissolved therein or causes the resin particles to swell slightly, and specifically, has a SP value difference of 1.0 or more, preferably, 2.0 or more, from the resin particles. For instance, alcohols having high SP values, such as methanol, ethanol, and n-propanol, and n-hexane and n-heptane, which have low SP values, are employable for styrene-acryl resin particles. An excessively large SP value difference results in poor wetting with respect to the resin particles, so that good dispersion of the resin particles cannot be obtained. Accordingly, an optimum SP value difference is preferably 2 to 5.

It is preferable that after dispersing the resin particles in the organic solvent in which the dye has been dissolved, the dispersed system be stirred while maintaining liquid temperature at or below the glass transition temperature of the resin particles. As a result, it is possible to dye the resin particles while preventing their condensation. The stirring may be performed using a commercially available stirrer such as a homomixer or a magnetic stirrer. Further, a dye may be added directly to slurry, that is, a dispersion where polymerized resin particles are dispersed in an organic solvent, obtained at the end of polymerization as in dispersion polymerization, and the dispersion may be heated and stirred on the above-described conditions. If the heating temperature exceeds the glass transition temperature of the resin particles, the resin particles fuse together. The method of drying slurry after dyeing is not limited in particular. The slurry may be subjected to suction drying after being filtered. Alternatively, the slurry may be directly subjected to suction drying without being subjected to separation by filtration. According to the present invention, colored particles obtained by air drying or suction drying after being separated by filtration hardly condense, and reproduce the particle size distribution of the input resin particles almost completely.

[Dissolution Suspension]

Next, a description is given of a method of manufacturing spherical toner particles by dissolution suspension.

According to dissolution suspension, resin is dissolved in a solvent to prepare an oil phase. The oil phase is emulsified in an aqueous phase composed of an aqueous medium. Thereafter, the solvent is removed from the emulsified dispersion so that resin particles are obtained.

As the aqueous medium, water may be employed alone or in combination with a solvent mixable with water. Examples of the mixable solvent include: alcohols such as methanol, isopropanol, and ethylene glycol; dimethylformamide; tetrahydrofuran; cellosolves such as methyl cellosolve; and lower ketones such as acetone and methyl ethyl ketone.

Examples of the employed resin include: polymers of styrenes and substituted styrenes such as polystyrene, poly(p-chlorostyrene), and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, styrene-isoprene copolymer, a styrene-acrylonitrile-indene copolymer, a styrene-maleic acid copolymer, and a styrene-maleate ester copolymer; polymethyl methacrylate; polybutyl methacrylate; polyvinyl chloride; polyvinyl acetate; polyethylene; polypropylene; polyester; epoxy resins; epoxy polyol resins; polyurethane; polyamide; polyvinyl butyral; poly acrylic resins; rosin; modified rosin; terpene resins; aliphatic or alicyclic hydrocarbon resins; aromatic petroleum resins; chlorinated paraffin; and paraffin wax. These resins may be employed alone or in mixture.

A solvent employable in preparing the oil phase is preferably volatile, having a boiling point lower than 100° C., so as to be removable easily. Examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone, which may be employed alone or in combination. Particularly, aromatic solvents such as toluene and xylene and halogenated hydrocarbons such as methylene chloride, 1,2-dichloroethane, chloroform, and carbon tetrachloride are preferable. Normally, the amount of solvent employed is 10 to 900 parts per 100 parts of a toner composition.

A colorant (or colorant masterbatch), which is another toner composition, a release agent, and a charge control agent may be added to and mixed with the oil phase at the same time that a dispersoid is formed in the aqueous medium, but more preferably, may be premixed with the oil phase.

Further, other raw toner materials including the colorant, the release agent, and the charge control agent are not required to be mixed into the aqueous medium at the time of forming particles therein, but may be added after forming the particles. For instance, after forming particles that do not include a colorant, a colorant may be added by a well-known dyeing method.

Mixers of normal stirring are employable to disperse the oil phase and the aqueous phase. More preferably, a homogenizer and a high-pressure homogenizer having a high-speed rotor and a stator, and mixers using a medium such as a ball mill, a bead mill, or a sand mill may be employed.

The method of dispersion is not limited in particular. Well-known facilities for low-speed shear dispersion, high-speed shear dispersion, friction-type dispersion, high-pressure jet dispersion, and ultrasonic dispersion are applicable. High-speed shear dispersion is preferable to have a dispersoid particle size of 2 to 20 μm. An emulsifier having rotating blades is not limited to a particular type. Those commonly available on the market as emulsifiers or dispersers are employable. For instance, such emulsifiers or dispersers include; continuous-type emulsifiers such as ULTRA-TURRAX manufactured (by IKA), POLYTRON manufactured (by KINEMATICA), TK AUTO HOMO MIXER manufactured (by TOKUSHU KIKA KOGYO CO., LTD.), EBARA MILDER (manufactured by EBARA CORPORATION), TK PIPELINE HOMO MIXER and TK HOMOMIC LINE FLOW (manufactured by TOKUSHU KIKA KOGYO CO., LTD.), COLLOID MILL (manufactured by SHINKO PANTEC CO., LTD.), SLASHER and TRIGONAL WET PULVERIZER (manufactured by MITSUI MINING COMPANY, LIMITED), CAVITRON (manufactured by EUROTEC), and FINE FLOW MILL (manufactured by Pacific Machinery & Engineering Co., Ltd.); and dual-use batch/continuous-type emulsifiers such as CLEARMIX (manufactured by MTECNIQUE) and FILMICS (by TOKUSHU KIKA KOGYO CO., LTD.).

In the case of employing a high-speed shear disperser, the number of revolutions (RPM) of the disperser is not specified in particular. Normally, the RPM is 1,000 to 30,000 rpm, preferably, 5,000 to 20,000 rpm. A dispersion period is not specified in particular. In the case of batch-type dispersion, normally, the dispersion period is 0.1 to 5 minutes. Temperature at the time of dispersion is normally 0 to 150° C. (under pressure), preferably, 10 to 98° C. Higher temperature conditions are preferable because the viscosity of a dispersion is suitably lowered at high temperatures, thus facilitating dispersion.

According to dissolution suspension, fine solid particles are pre-dispersed in an aqueous medium in order to stabilize a dispersed oil phase.

Further, another dispersant may be employed together in order to control the adsorption characteristic of the fine solid particles to liquid droplets. The other dispersant may be added before emulsifying a toner component or at the time of removing a volatile component after the emulsification.

Next, a description is given of a carrier for a two-component developer in the case of using toner as a two-component system developer.

In this case, the toner may be employed in mixture with a magnetic carrier. The ratio of the toner to the carrier contained in the developer is preferably 1 to 10 parts by weight of the toner per 100 parts by weight of the carrier. Any of iron powder, ferrite powder, and magnetite powder of 20 to 200 μm in particle size, and a magnetic resin carrier, which are conventionally well-known, may be employed as the magnetic carrier.

Examples of a coating material include: amino resins such as a urea-formaldehyde resin, a melamine resin, a benzoguanamine resin, a urea resin, and polyamide resins; and epoxy resins. Further, coating materials such as: polyvinyl and polyvinylidene resins such as acrylic resins, a polymethyl methacrylate resin, a polyacrylonitrile resin, a polyvinyl acetate resin, a polyvinyl alcohol resin, a polyvinyl butyral resin, polystyrenic copolymers such as a polystyrene resin and a styrene-acrylic copolymer, and halogenated olefin resins such as polyvinyl chloride; polyester resins such as a polyethylene terephthalate resin and a polybutylene terephthalate resin; polycarbonate resins; a polyethylene resin; a polyvinyl fluoride resin; a polyvinylidene fluoride resin; a polytrifluoroethylene resin; a polyhexafluoropropylene resin; a copolymer of vinylidene fluoride and an acrylic monomer; a copolymer of vinylidene fluoride and vinyl fluoride; fluoroterpolymers such as a terpolymer of tetrafluoroethylene, vinylidene fluoride, and a non-florinated monomer; and a silicone resin are also employable.

Further, conductive powder may be contained in the coating resin. As the conductive powder, metal powder, carbon black, titanium oxide, tin oxide, or zinc oxide is employable. The conductive powder is preferably 1 μm or less in average particle size. If the average particle size is greater than 1 μm, it is difficult to control electric resistance.

Next, a description is given of a method of manufacturing toner according to this embodiment.

Synthesis of Toner Binder

In a reaction vessel with a cooling pipe, a stirrer, and a nitrogen introduction pipe, 724 parts of an addition product of bisphenol A and 2 moles of ethylene oxide, 276 parts of terephthalic acid, and two parts of dibutyl tin oxide were placed so that polycondensation occurred for 8 hours at 230° C. at atmospheric pressure and further for 5 hours under a reduced pressure of 10 to 15 mmHg. As a result, a polyester resin of a peal molecular weight of 5300 was obtained. Then, 100 parts of the polyester resin were dissolved in and mixed with 100 parts of ethyl acetate, so that an ethyl acetate solution as a toner binder was obtained.

Production of Toner

In a hermetically sealed pot, 200 parts of the ethyl acetate solution, which is a toner binder, 5 parts of carnauba wax, 4 parts of a copper phthalocyanine blue pigment, and 1 part of zinc di-tertiary-butyl salicylate were placed, and ball mill dispersion was performed for 24 hours using zirconia beads of 5 mmϕ, so that a toner composition was obtained.

In a beaker, 600 parts of ion-exchanged water, 6 parts of partially-saponified polyvinyl alcohol, and 0.3 parts of sodium dodecylbenzenesulfonate were placed so as to be evenly dissolved and dispersed.

Next, maintaining the internal temperature of the beaker at 20° C. and stirring the liquid at 12,000 rpm by TK HOMO MIXER (manufactured by TOKUSHU KIKA KOGYO CO., LTD.), the toner composition was put in the liquid so that stirring and emulsification were performed for 3 minutes. Then, this liquid mixture was transferred into a flask with a stirring bar and a thermometer, and 0.3 parts of sodium lauryl sulfate were added to be stirred and dissolved for 30 minutes under room temperature. Then, the solvent was removed under a reduced pressure of 50 mmHg at 30° C. The analysis of the dispersion by gas chromatography showed that 50 ppm of ethyl acetate remained with respect to toner particles. Then, 120 parts of 35% concentrated hydrochloric acid was added so that tricalcium phosphate was dissolved, and thereafter, filtration was performed. Cake separated and obtained by the filtration was re-dispersed into distilled water and filtered. Cleaning was performed by repeating this operation three times. Thereafter, suction drying was performed for 24 hours at 40° C. so that colored particles were obtained.

Then, 3 parts by weight of silica and 2 parts by weight of titanium oxide particles were mixed with 95 parts by weight of the obtained colored particles by a Henschel mixer. The mixture was put through a sieve, so that toner was obtained.

Then, 5 parts by weight of the toner were mixed with 95 parts by weight of a silicon coat carrier (of a magnetite core) of 50μ in toner weight-average particle size by a rocking mixer, so that a two-component developer was obtained.

Thus, by using highly spherical toner made by dissolution suspension, an image-forming apparatus of high image quality with reduced toner production cost can be formed.

Comparison of Cleaning Characteristics

Loading the vibration application cleaning blade of the present invention, cleaning characteristics and frictional resistances between a photosensitive body (image carrier) and the blade were measured and evaluated. The frictional resistances are the surface friction coefficients and the rotational torques of replaced photosensitive bodies.

Charging and development conditions were as follows. Evaluation timing was fixed.

Operational speed: 100 mm/sec

Image carrier: Organic compound photosensitive body (organic compound photoconductor: OPC) of a film thickness of 30μ

Charging: Air gap distance between a charging roller and an image carrier: 50 μm Applied bias:

DC component: −900 V

AC component:

Vpp: 2.2 kV

Frequency: 1.5 kHz

Waveform: Sinusoidal

Development: Applied bias:

DC component: −500 V

AC component:

Vpp: 1.5 kV

Frequency: 2.2 kHz

Waveform: Rectangular

Environmental conditions:

Temperature: 23° C.

Relative humidity: 50%

Blade: Thickness: Vibration part: 0.3 mm

Blade part: 0.2 mm (In a comparison based on the presence or absence of vibration application, values were equalized by setting a driving bias to a piezoelectric element to zero.)

Material: Polyurethane (hardness as a bulk is approximately 70° according to JIS-A)

Applied weight (pressure at the end part of the blade): 25 g/cm

Evaluation of Transfer Rate

The rate of transfer was evaluated (measured) as follows. While outputting a solid image onto the surface of the image carrier, the operation was stopped. A toner image between a developing unit and a transfer unit and a toner image between the transfer unit and a transfer cleaning unit were transferred onto white paper using Scotch (product name; manufactured by SUMITOMO 3M Limited) tape, and the toner densities (tape densities) were measured by Macbeth RD514 reflection densitometer (product name).

At this point, letting the tape density between the development unit and the transfer unit, the tape density between the transfer unit and the cleaning unit, and the density of white paper onto which only Scotch tape was transferred be Ddt, Dtc, and Dref, respectively, transfer efficiency was calculated by the following equation (1):

$$(\text{Transfer Efficiency}) = \frac{(Ddt - Dref) - (Dtc - Dref)}{Ddt - Dref} \times 100 \quad (1)$$

Evaluation of Cleaning Characteristics

Like the above-described rate of transfer, the cleaning characteristic was also evaluated using Scotch tape.

Toner remaining on the surface of the photosensitive body, which is an image carrier, after a transfer process (transfer residual toner) was transferred onto white paper using Scotch tape, and the toner density was also measured by Macbeth RD514 reflection densitometer. If the difference between the measured density and the density of a blank (white paper on which only Scotch tape was applied) was 0.01 or less, the cleaning characteristic was determined to be "good" (indicated as "GOOD" in the following lists of evaluation results). If the difference exceeded 0.01 (that is, if the measured density was high), the cleaning characteristic was determined to be "not good" (indicated as "NG" in the lists of evaluation results).

An image pattern whose attachment on the photosensitive body was 0.1 mg/cm$^2$ in amount was prepared, and was output for 50,000 A3 sheets of paper in its longitudinal direction as actual outputs. When the outputting of the 50,000 sheets of paper was completed, an image pattern forming a solid image was output halfway, and the rate of transfer and the rate of cleaning (cleaning characteristic) were measured as indicated in the above-described measurement methods.

Measurement of Resonance Frequency

Figure 15:
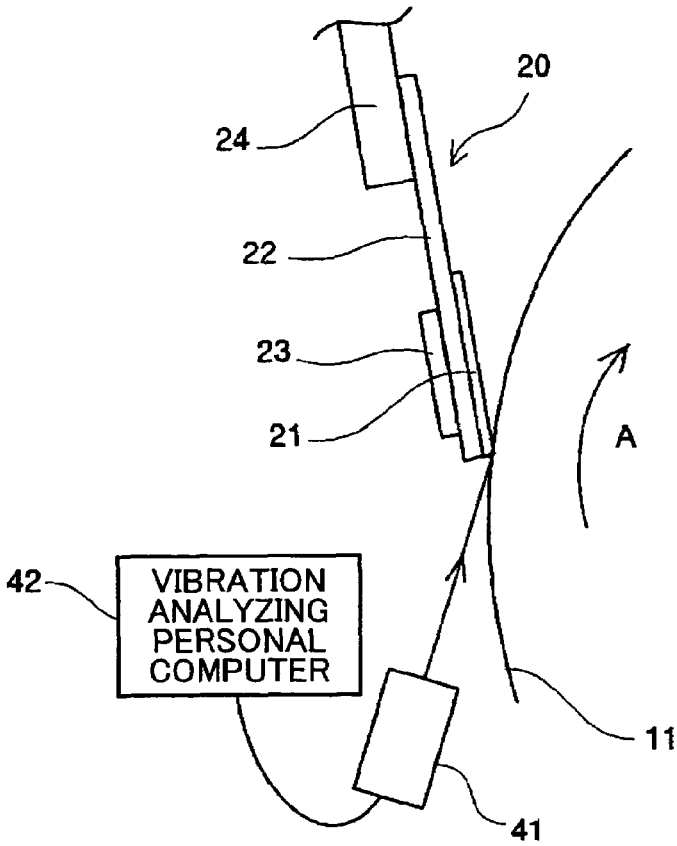
FIG. 15 is a diagram for illustrating the measurement of a resonance frequency according to the first embodiment of the present invention.

Referring to FIG. 15, a vibration measurement unit 41 for measuring a resonance frequency was provided, and the output signal of the vibration measurement unit 41 was captured by a vibration analyzing personal computer 42. The vibration measurement unit 41 measures a frequency characteristic at the time of vibration by a measurement principle called Laser Doppler Measurement. The actually employed laser Doppler vibrometer was Laser Doppler Displacement Meter OFV-303 (product name; manufactured by Polytec PI, Inc.).

FFT analysis was performed by the vibration analyzing software of the vibration analyzing personal computer 42 so as to detect a frequency with which the resonance frequency coincides.

In order to reduce time in detecting and measuring the resonance frequency, noise having certain amplitude may be input as a waveform applied to a piezoelectric element. In the case of a normal cleaning operation, a sinusoidal wave or a rectangular wave is input for driving. In the case of detecting the resonance frequency, however, noise (often referred to as white noise) is input.

Frictional Resistance and Resonance Frequency

A description is given of a variation in the resonance frequency in the case of intentionally varying frictional resistance in an image-forming apparatus including the above-described laser Doppler vibrometer.

It is difficult to directly measure the frictional resistance between the blade and the image carrier by incorporating a frictional resistance measurement unit into the actual image-forming apparatus. Accordingly, a description is given herein of a configuration for setting and controlling the driving frequency of the vibration application parts based on the coefficient of friction and the rotational torque of the image carrier that are relatively easy to measure. Coefficient of friction and torque, which are both correlated with frictional resistance, are equivalent in a fundamental sense.

(1) Coefficient of Friction of Photosensitive Body (Image Carrier)

Figure 16:
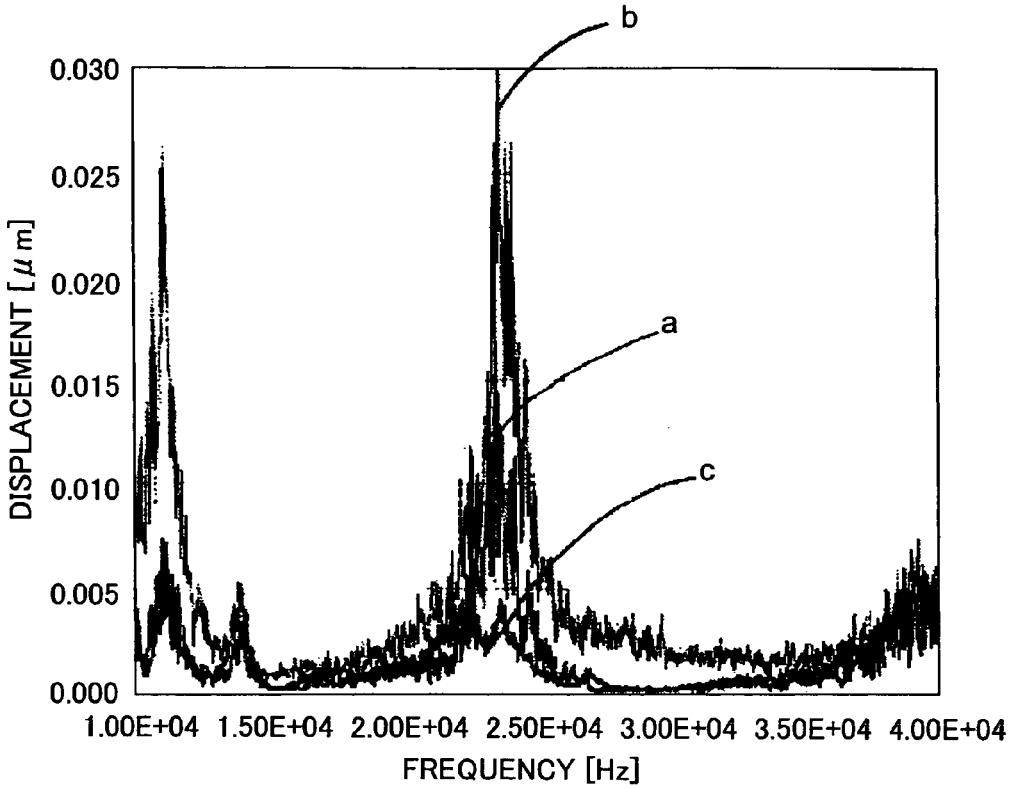
FIG. 16 is a graph showing results of the measurement of a frequency-displacement relationship according to the first embodiment of the present invention.

FIG. 16 is a graph showing the results of the measurement of the resonance frequency at the time of driving the vibration application cleaning blade 20 of FIG. 9 under a fixed condition (with the same white noise amplitude) with respect to initial values of the coefficient of friction of the photosensitive body measured by Euler's belt theory with respect to paper.

FIG. 16 shows that resonance frequencies that increase vibration displacement exist around 24 kHz. The accurate frequency at this point is defined as a frequency b. FIG. 16 also shows that the frequency maximizing the displacement differs depending on the coefficient of friction of the photosensitive body as indicated in FIG. 16 by a frequency a, the frequency b, and a frequency c existing at intervals of approximately 1 kHz. The cause of these results has not been clarified in detail, but may be presumed as follows. As the coefficient of friction of the photosensitive body increases, the nip part of the blade, which performs cleaning at the end of the blade, is pulled toward the downstream side. Therefore, even under the same piezoelectric element driving condition, the resonance frequency varies depending on a combination of the blade and the photosensitive body.

Table 1 shows the determination results of the cleaning characteristic on the photosensitive body at the time of inputting a sinusoidal wave as a waveform with the obtained resonance frequency being employed as a driving frequency for each coefficient of friction and at the time of varying only the coefficient of friction of the photosensitive body with the driving frequency being fixed at the frequency b.

TABLE 1

| Friction coefficient | Cleaning characteristics for friction coefficients by driving at respective resonance frequencies | Cleaning characteristics for friction coefficients by driving at the fixed resonance frequency for friction coefficient b |
|---|---|---|
| a | GOOD | NG |
| b | GOOD | GOOD |
| c | GOOD | NG |

According to Table 1, even if the coefficient of friction of the photosensitive body varies, a good cleaning characteristic can be obtained by driving the piezoelectric elements at a resonance frequency generated at that point. On the other hand, if the piezoelectric elements are driven at a fixed frequency even if the coefficient of friction of the photosensitive body varies, a good cleaning characteristic cannot be obtained.

As described above, cleaning with the vibration application cleaning blade requires a certain vibration displacement, which may be realized by using a resonance frequency. Even if the resonance frequency is not usable, it is possible to apply vibration under certain conditions. In this case, however, the vibration is very small, and a voltage necessary for driving is prone to be large. Undesirably, this imposes loads on the piezoelectric elements, and requires an extra power supply of a large capacity for driving the piezoelectric elements.

According to this method of varying the resonance frequency in accordance with the coefficient of friction of the photosensitive body, in the case of actually forming an image in an image-forming apparatus where the resonance frequency is unchangeable during operations because, for instance, a driver circuit that cannot change frequencies during operation is provided to reduce cost, or a resonance frequency have a considerable spreading (a blade where the bottom of the resonance frequency spreads relative to a frequency in the center position), the piezoelectric elements may be driven at a frequency in the vicinity of the resonance frequency so that a certain vibration displacement may be secured and a good cleaning characteristic may be obtained. Accordingly, it is preferable that a resonance frequency determined by the combination of the surface of the photosensitive body and the vibration application cleaning blade at the initial state be detected (measured) so that the piezoelectric elements are driven at the resonance frequency.

(2) Rotational Torque of Image Carrier

A rotational torque meter was attached to the shaft of a drum-like image carrier attached inside an image-forming apparatus as shown in FIG. 8, and torque was measured when the image carrier was rotated. When the rotational torque was measure, only the cleaning blade 21 having the vibration application parts 23 attached thereto was caused to come into contact with the image carrier. A charging process, a development process, and a transfer process that were necessary to prepare an image were incorporated into the process of evaluating the cleaning characteristic as described above. As a measurement unit (a detection unit) measuring (detecting) the frictional resistance between the blade and the image carrier, it is most suitable to incorporate the torque meter into the image-forming apparatus in terms of directly observing the frictional resistance.

In this case, the measurement was performed with respect to the drum-like OPC. However, the same measurement is also performable with respect to a belt-like photosensitive body. In order to remove toner with the blade, it is necessary to put the blade in contact with the photosensitive body. Accordingly, it is preferable to position the torque meter as close to the blade as possible. In the case of the belt photosensitive body, a certain pressure is required for cleaning between the belt and the blade. Therefore, rollers for engaging the belt are often provided. It is preferable to attach the torque meter to the shaft of the engaging roller closest to the blade.

Vibrations at the time of operating the vibration application cleaning blade 20 while varying the rotational torque of the photosensitive body intentionally as in the above-described case of varying coefficients of friction of the photosensitive body were analyzed so as to evaluate the cleaning characteristic. As described above, white noise was also input to the piezoelectric elements so that the vibration analysis was performed on the personal computer.

The results of the vibration analysis are not graphically represented. However, as in the above-described results, a different resonance frequency increasing vibration displacement was found to exist for each torque value around 24 kHz. Letting the accurate frequency at this point be a frequency e, the frequency e was equivalent to the above-described frequency b. Further, as in the above-described results, the frequency maximizing the displacement was found to differ depending on the torque of the photosensitive body, varying as a frequency d, the frequency e, and a frequency f existing at intervals of approximately 1 kHz.

When the cause of these results is considered in detail, it is believed that these results are produced for the same reason as in the case of the coefficient of friction of the photosensitive body. That is, it is considered that the phenomenon of the torque increase is caused by an increasing load between the blade nip and the surface of the photosensitive body. It is presumed that the load is generated by the nip of the blade performing cleaning being pulled toward the downstream side.

Table 2 shows the determination results of the cleaning characteristic on the photosensitive body at the time of inputting a sinusoidal wave as a waveform with the obtained resonance frequency being employed as a driving frequency for each torque value and at the time of varying only the torque (value) of the photosensitive body with the driving frequency being fixed at the frequency e.

TABLE 2

| Rotational torque value | Cleaning characteristics for torque values by driving at respective resonance frequencies | Cleaning characteristics for torque values by driving at the fixed resonance frequency for torque value e |
|---|---|---|
| d | GOOD | NG |
| e | GOOD | GOOD |
| f | GOOD | NG |

According to Table 2, even if the torque of the photosensitive body varies, a good cleaning characteristic can be obtained by driving the piezoelectric elements at a resonance frequency generated at that point. On the other hand, if the piezoelectric elements are driven at a fixed frequency even if the torque of the photosensitive body varies, a good cleaning characteristic cannot be obtained. This is caused by the same reason as described above.

Thus, according to the method of varying the resonance frequency in accordance with a torque variation at the time of the rotation of the photosensitive body, in the case of actually forming an image in an image-forming apparatus where a certain durability is to be provided, that is, the surface of the photosensitive body is prone to change due to the adhesion of toner so that the frictional force between the blade and the photosensitive body is prone to change, cleaning can be optimized by estimating a variation in the resonance frequency from a variation in the torque meter so that the driving condition is changed to an optimum resonance frequency that allows a certain vibration displacement to be secured.

Cleaning Characteristics and Resonance Frequency

The above-described method of controlling the driving of the piezoelectric elements forming the vibration application cleaning blade employs a laser Doppler vibrometer in a detection method provided in the image-forming apparatus. If a further reduction in cost is required, it is possible to estimate a resonance frequency from the cleaning characteristic itself so as to optimize a cleaning state. A description is given below of this method.

Table 1 and Table 2 show that vibration displacement cannot be obtained, thus resulting in a poor cleaning characteristic, by driving the piezoelectric elements at a frequency other than a resonance frequency determined by the correlation between the vibration application cleaning blade and the photosensitive body. Accordingly, when an output image tends to be affected by a poor cleaning characteristic, for instance, when toner adheres to a part other than an image on an output, the cleaning characteristic can be improved by securing vibration displacement by reading a variation in the resonance frequency from the evaluation results of the cleaning characteristic and controlling a frequency at which the piezoelectric elements are driven (the driving frequency of the piezoelectric element) to a value approximating the resonance frequency.

In this case, it is unknown whether the driving frequency has been shifted from the resonance frequency to a higher frequency or a lower frequency as shown in FIG. 16. In the case of substantially the same cleaning characteristic level, the driving frequency may have been shifted to either a higher frequency or a lower frequency. Accordingly, after shifting the driving frequency to one side (a higher or lower frequency) and outputting several sheets of paper, if the cleaning characteristic further deteriorates, the driving frequency may be controlled (shifted) to the other side. At this point, a simple method is for a human operator to take a direct look at actual output images and reflect the determination result of the cleaning characteristic in the image-forming apparatus.

If the image-forming apparatus is a printer, the set conditions may be changed by the printer driver of a host computer transmitting data to the printer.

Further, if it is desired that this operation be performed automatically, a line sensor detecting residual toner may be provided on the downstream side of the vibration application cleaning blade in the rotational direction of the photosensitive body. The line sensor may detect the cleaning characteristic on the surface of the photosensitive body, and input the result of the detection as a signal to the main controller, thereby changing the driving frequency of the vibration application parts. As a result, the cleaning characteristic can be maintained or improved.

Thus, in both cases of automatic operation and non-automatic operation requiring manual setting, the driving frequency of the piezoelectric elements can be changed based on the results of cleaning so as to be at an optimum condition for cleaning.

Thus, the driving part can drive the vibration application parts at a driving frequency corresponding to a resonance frequency by making the driving frequency variable.

Further, by setting the driving frequency based on the frictional resistance between the blade member and the image carrier, the frictional resistance, correlated with the resonance frequency and in practice difficult to measure in the image-forming apparatus, can be employed. As a result, the vibration application parts can be driven easily at the driving frequency corresponding to the resonance frequency, so that an optimum condition for cleaning can be set.

In this case, by causing the driving frequency to be set automatically, semi-automatically, or manually based on the coefficient of friction on the surface of the photosensitive body, correlated with the frictional resistance, the frictional resistance can be understood (detected) simply and easily (with respect to an image carrier of low durability on which film peeling progresses). As a result, the driving frequency can be easily set and controlled to the resonance frequency so as to drive the piezoelectric elements with a simple configuration without large-scale facilities, so that an optimum condition for cleaning can be set.

Further, by causing the driving frequency to be set based on the rotational torque of the image carrier, correlated with the frictional resistance, a change over time in the frictional resistance can be better followed, and the frictional resistance on a highly durable image carrier can be detected. As a result, even in an image-forming apparatus in which the state of the surface of an image carrier changes greatly over time or an image-forming apparatus having a highly durable image carrier that needs no replacing, a rotational load can be determined with accuracy from the rotational torque of the image carrier, and the driving frequency can be set and controlled in accordance with a variation in the rotational load so as to be set to an optimum condition for cleaning.

Further, by causing the driving frequency to be set based on the detection results of the cleaning characteristic, a variation in the resonance frequency of the cleaning blade caused by the vibration application parts in the image-forming apparatus can be detected, so that an optimum condition for cleaning can be set. Generally, the cleaning characteristic is evaluated by the amount of toner on the photosensitive body after the passage of the blade.

Figure 17:
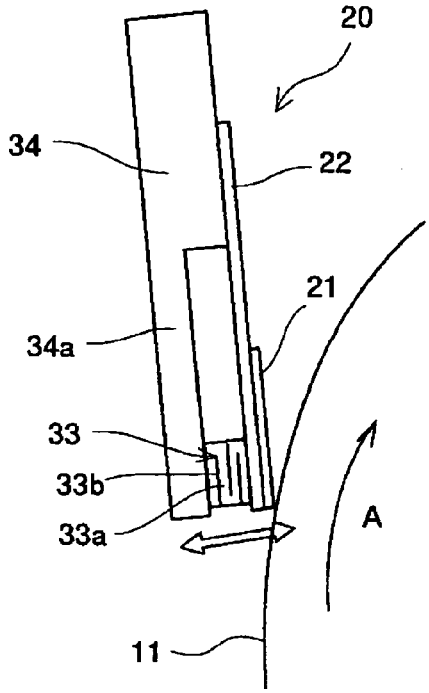
FIG. 17 is a diagram for illustrating another configuration of the application vibration cleaning blade of the cleaning unit according to the first embodiment of the present invention.
Figure 18:
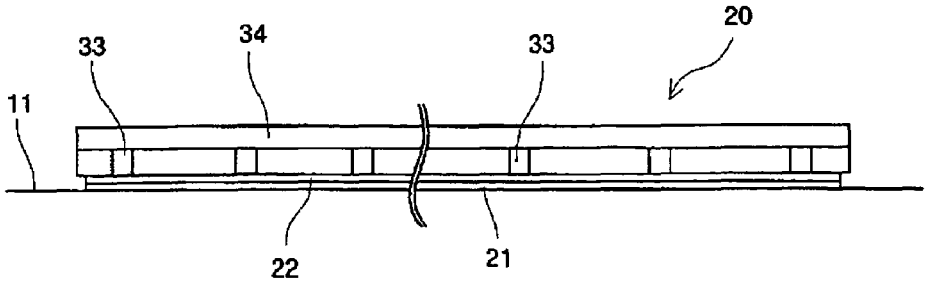
FIG. 18 is a diagram showing a configuration of the application vibration cleaning blade in the width directions of an image carrier according to the first embodiment of the present invention.

Next, a description is given, with respect to FIGS. 17 and 18, of another configuration of the vibration application cleaning blade 20 of the cleaning unit 16.

According to this configuration, multilayer piezoelectric elements are employed as vibration application parts 33 to provide vibration to the vibration member 22. The multilayer piezoelectric elements each have a high natural frequency of 50 to 100 kHz and generate an extremely large displacement force. Accordingly, by using the multilayer piezoelectric elements, a configuration that can respond to high frequencies can be easily provided even if the vibration member 22 has a great thickness.

In each of the multilayer piezoelectric elements forming the vibration application parts 33, each layer includes alternate layers of a piezoelectric layer 33*a* and an internal electrode 33*b* each of 10 μm. The internal electrode 33*b* are extended alternately onto first and second opposing end faces so as to be connected to end face electrodes (external electrodes). The displacement of each multilayer piezoelectric element in its layer direction, that is, the d33 direction, is utilized.

Alternatively, it is also possible to employ a configuration where the displacement of each multilayer piezoelectric element in a surface direction perpendicular to its layer direction, that is, the d31 direction, is utilized. In this case, a great displacement can be obtained with low voltage, so that the cost of a driver (driver circuit) can be reduced. This configuration is equal to that shown in FIG. 15 except for the multilayer piezoelectric elements forming the vibration application parts 23.

The vibration member 22 is shaped like a thin plate to be elastically deformable. The fixed end of the vibration member 22 is fixed to a fixing member 34 of high rigidity having a support part 34*a* opposing the vibration member 22 so that the multilayer piezoelectric elements, which are the vibration application parts 33, are sandwiched between the support part 34*a* of the fixing member 34 and the vibration member 22. The blade member 21 is disposed in the end region of the surface of the vibration member 22 on the side opposite to the vibration application parts 33 so that vibration from the vibration application parts 33 is transmitted to the blade member 21 via the vibration member 22.

Thus, by providing the vibration application parts 33 between the fixing member 34 and the vibration member 22, vibration can be transmitted to the vibration member 22 with efficiency.

Referring to FIG. 18, the vibration application parts 33 are provided in the width directions of the image carrier 11. If the blade member 21 has a relatively narrow width, the vibration application parts 33 may be replaced with a single multilayer piezoelectric element having a relatively large sectional area.

Figure 19:
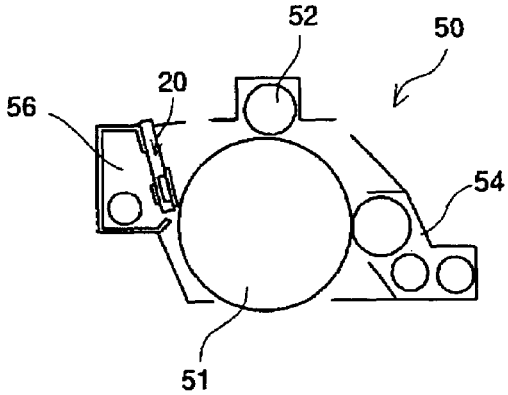
FIG. 19 is a sectional view of a process cartridge according to the first embodiment of the present invention.

Next, a description is given, with reference to FIG. 19, of a process cartridge 50 including a cleaning unit 56 according to the present invention. FIG. 19 is a sectional view of the process cartridge 50.

The cleaning unit 56 according to the present invention and at least one of an image carrier 51, a charging unit 52, a development unit 54, and a transfer unit (not graphically represented) may be integrated into the process cartridge 50. The process cartridge 50 is attachable to and detachable from the main body of an image-forming apparatus such as a copier or a printer.

The cleaning unit 56 is provided in the detachable process cartridge 50. As a result, better maintainability can be achieved, and the cleaning unit 56 can be replaced easily by replacing the process cartridge 50 as a unit.

Figure 20:
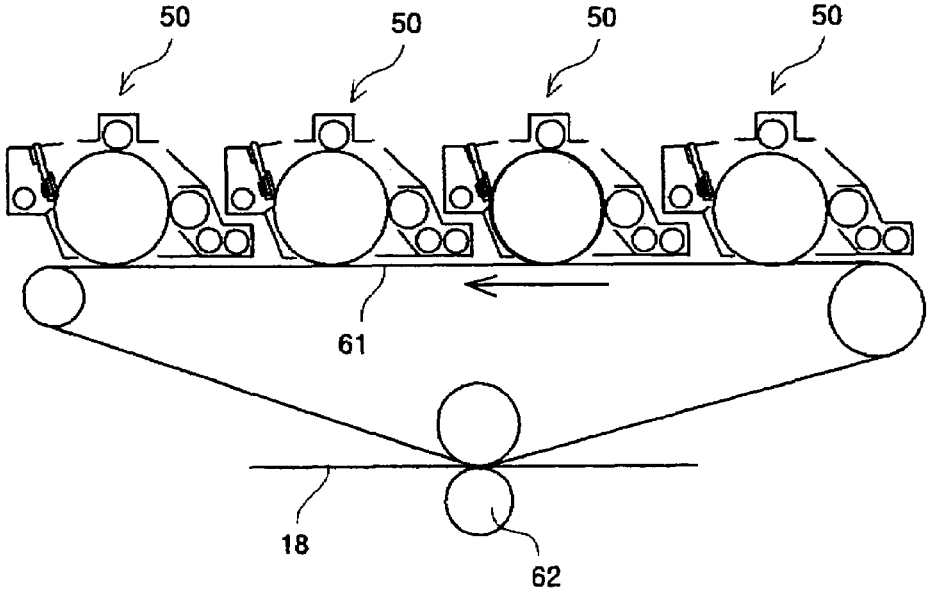
FIG. 20 is a schematic diagram showing an image-forming apparatus including the process cartridges according to the first embodiment of the present invention.

Next, a description is given, with reference to FIG. 20, of a color image-forming apparatus employing the process cartridge 50 according to the present invention.

The color image-forming apparatus of FIG. 20 includes a plurality of process cartridges 50 of respective colors juxtaposed along a laterally extending transfer belt (image carrier) 61.

Referring to FIG. 20, the four process cartridges 50 of yellow, magenta, cyan, and black are provided in this order from upstream (right) to downstream (left) in the direction indicated by arrow. Toner images developed on the image carriers 51 by the process cartridges 50 are successively transferred onto the laterally extending transfer belt 61 to which a transfer voltage is applied.

Thus, a yellow image, a magenta image, a cyan image, and a black image are successively formed and transferred (superposed) onto the transfer belt 61 by multilayer transfer so as to be transferred together onto the transfer material 18 by a transfer unit 62. A multilayer (composite) toner image on the transfer material 18 is fixed by a fixing unit (not graphically represented). The process cartridges 50 are arranged in the order of yellow, magenta, cyan, and black as described above. However, the order of arrangement is not limited to this, and the process cartridges 50 may be juxtaposed in any order. Conventionally, a color image-forming apparatus, which includes a plurality of image formation parts, is large in size. Further, when individual units such as a cleaning unit and a charging unit fail or reach the end of their useful service life, and have to be replaced, it takes a lot of time and effort to replace units due to the complexity of the apparatus.

Therefore, according to this embodiment, by integrating the image carrier 51, the charging unit 52, the development unit 54, and the cleaning unit 56 into the process cartridge 50, a small-size, highly durable color image-forming apparatus whose units can be replaced easily by a user can be provided.

Thus, according to the cleaning unit of this embodiment, vibration application parts for vibrating a cleaning blade may be driven with a resonance frequency being employed as a driving frequency. Accordingly, vibration can be secured so that a cleaning characteristic can be maintained.

Further, according to the image-forming apparatus of this embodiment, which includes the cleaning unit of this embodiment, cleaning deficiency is eliminated so that a high-quality image can be formed.

Further, according to the process cartridge of this embodiment, which includes the cleaning unit of this embodiment, cleaning deficiency is eliminated so that a high-quality image can be formed.

Further, according to the color image-forming apparatus of this embodiment, which includes the cleaning units of this embodiment, cleaning deficiency is eliminated so that a high-quality color image can be formed.

Second Embodiment

Figure 21:
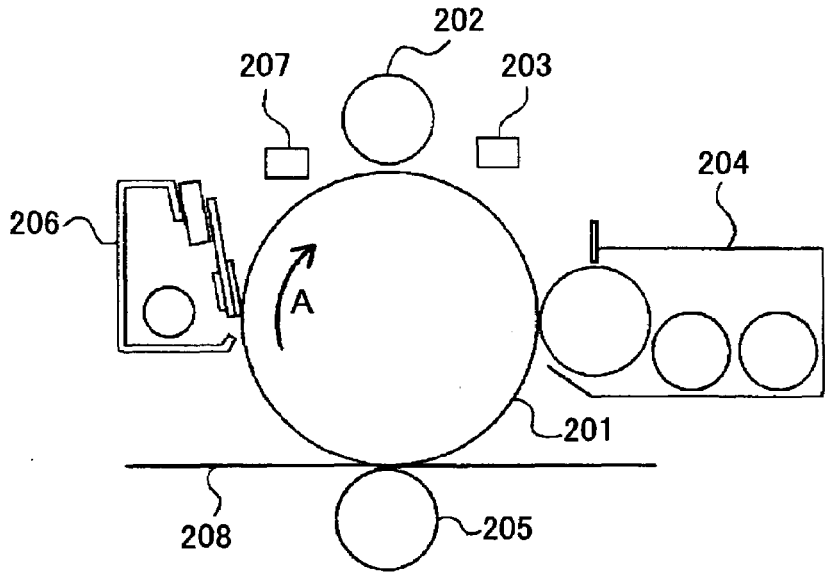
FIG. 21 is a schematic diagram showing an image-forming apparatus according to a second embodiment of the present invention.

FIG. 21 is a schematic diagram showing an image-forming apparatus according to a second embodiment of the present invention.

The image-forming apparatus includes an image carrier 201 rotatable in a direction indicated by arrow A. The image-forming apparatus also includes a charging unit 202, an exposure unit 203, a development unit 204, a transfer unit 205, a cleaning unit 206, and a discharger 207 disposed around the image carrier 201. The image-forming apparatus further includes a fixing unit (not graphically represented) for fixing a toner image transferred from the image carrier 201 onto a transfer material 208.

The charging unit 202 is disposed at a predetermined distance from the surface of the image carrier 201. Alternatively, the charging unit 202 may be disposed in contact with the image carrier 201. The image carrier 201 is charged to a predetermined polarity and with a predetermined potential by applying a bias to the charging unit 202. The exposure unit 203 employs a laser diode (LD) or a light-emitting diode (LED) as a light-emitting element, and forms an electrostatic latent image on the image carrier 201 by emitting light thereonto based on image data. The development unit 204 contains fixed magnet rollers and a freely rotatable developer carrier. Developer is held on the developer carrier. In this image-forming apparatus, two-component magnetic brush development employing a two-component developer formed of toner and carrier as the developer is employed. Other development methods such as single-component development using no carrier may be employed. A voltage is applied from a development bias power supply to the developer carrier. The potential difference between the development bias and the potential of the electrostatic latent image formed on the surface of the image carrier 201 causes charged toner to adhere to the electrostatic latent image so that development is performed in a development area. As a result, a toner image is formed on the surface of the image carrier 201.

The transfer unit 205 comes into contact with the surface of the image carrier 201 with a predetermined pressing force so as to apply voltage thereto at the time of transferring the toner image. As a result, the transfer unit 205 transfers the toner image on the surface of the image carrier 201 onto the transfer material 208 in a transfer nip part between the image carrier 201 and the transfer unit 205. In this image-forming apparatus, the transfer of the toner image is performed using a transfer roller. Alternatively, the transfer of the toner image may also be performed using other transfer means such as a Colutron ion source or a transfer belt. The discharging unit 207 discharges the residual electric charge of the image carrier 201 from which the residual toner has been removed by the cleaning unit 206. The discharging unit 207 is of a photo-discharge type using an LED.

Figure 22:
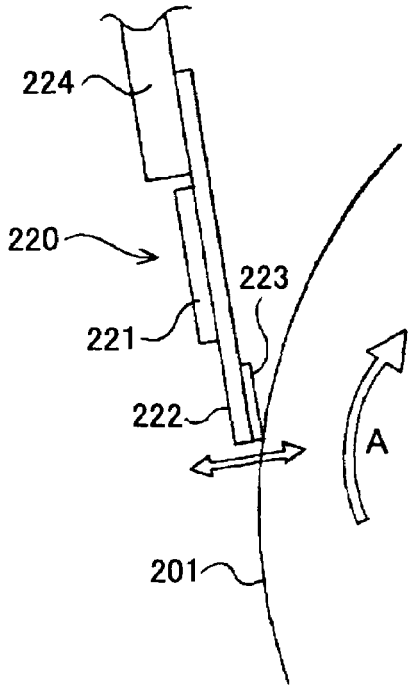
FIG. 22 is a schematic diagram showing a cleaning unit in the case of employing piezoelectric elements (PZTs) as vibration application members of the image-forming apparatus according to the second embodiment of the present invention.

Referring to FIG. 22, the cleaning unit 206 of FIG. 21 includes vibration application members 221, a vibration member 222, and an elastic blade member 223 as a cleaning blade 220. A force to press the blade member 223 against the image carrier 201 is provided by the elastic force of the vibration member 222 to vibrate the blade member 223 so that residual toner is removed from the image carrier 201. The toner removed from the image carrier 201 by the cleaning unit 206 is conveyed by a toner conveying member (not graphically represented) to be stored in a waste toner bottle (not graphically represented) as waste toner. The stored toner is collected by a service person or conveyed to, for instance, the development unit 204 as recycled toner to be used for development.

Figure 23A:
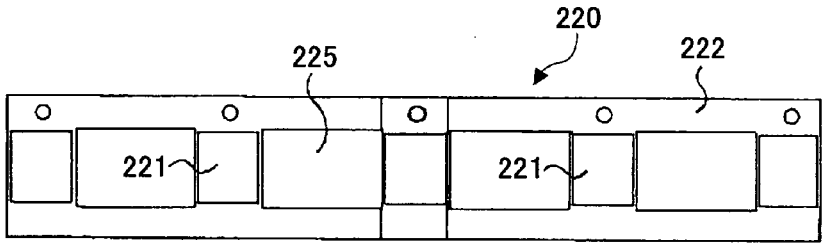
FIGS. 23A and 23B are a front view and a right side view, respectively, of a cleaning blade according to the second embodiment of the present invention.
Figure 23B:
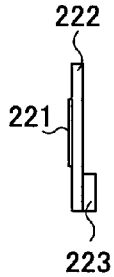

FIG. 22 is a schematic diagram showing the cleaning unit 206 in the case of employing piezoelectric elements (PZTs) as the vibration application members 221. FIGS. 23A and 23B are a front view and a right side view, respectively, of the cleaning blade 220. The vibration application members 221 provide vibration to the vibration member 222 that is made of a vibratable material having a higher stiffness than the elastic blade 21, such as a metallic material such as a mild steel plate or a SUS plate or a molded resin member including carbon or glass fiber. Referring to FIG. 23A, the vibration application members 221 are arranged on the vibration member 222 in the direction of the width of the image carrier 201. Depending on the configuration of the vibration member 222, the vibration application members 221 may be attached to any positions where the vibration application members 221 can apply vibration to the vibration member 222 on the vibration member 222 between an end thereof fixed to a fixing member 224 and the other end on the cleaning blade 223 side. In FIG. 23A, reference numeral 225 denotes holes formed in the vibration member 222 between the vibration application members (PZTs) 221.

Each of the vibration application members 221 is a single-plate PZT formed of lead zirconate titanate, and includes Ag electrodes formed on its first and second opposing surfaces by printing and burning, the second surface being joined to the vibration member 22. When a voltage of 100 to 300 V is applied to the PZTs 221 of 0.3 to 0.5 mm in thickness that have been polarized using the Ag electrodes, contractive deformation in the plate surface direction occurs in the PZTs 221. As a result, deformation vibration that causes the vibration member 222 to deflect can be provided. This flexural vibration achieves good deformation efficiency when the PZTs 221 and the vibration member 222 have substantially the same stiffness. For instance, a metal vibration member of 0.2 to 0.4 mm in thickness or a resin vibration member of 0.3 to 1.0 mm in thickness may be employed as the vibration member 222. The contraction deformation of each PZT 221 in its plate surface (in-plane) direction is proportional to the voltage applied thereto.

Figure 24A:
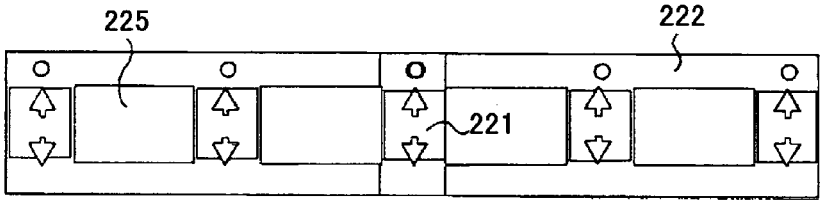
FIGS. 24A and 24B are a front view and a right side view, respectively, of the cleaning blade in the case of applying voltages of the same phase to the vibration application members in PZT in-plane directions of a blade member indicated by arrow in FIG. 24A according to the second embodiment of the present invention.
Figure 24B:
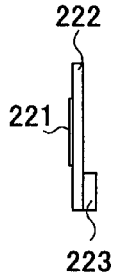
Figure 25:
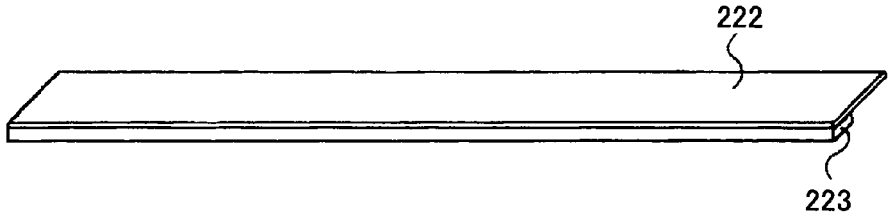
FIG. 25 is a diagram showing a state where vibration having no phase difference along the length of the blade member can be obtained in the end part thereof according to the second embodiment of the present invention.
Figure 26A:
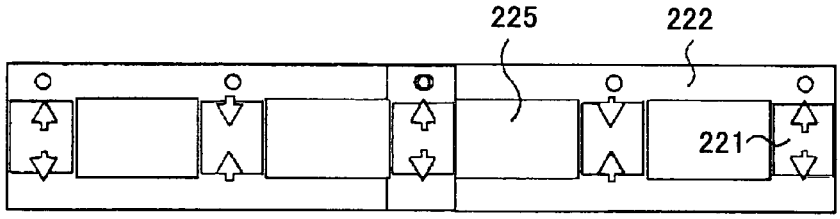
FIGS. 26A and 26B are a front view and a right side view, respectively, of the cleaning blade in the case of applying voltages of opposite phases to the vibration application members in PZT in-plane directions of a blade member indicated by arrow in FIG. 26A according to the second embodiment of the present invention.
Figure 26B:
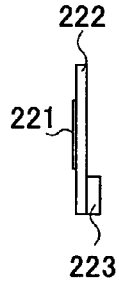
Figure 27:
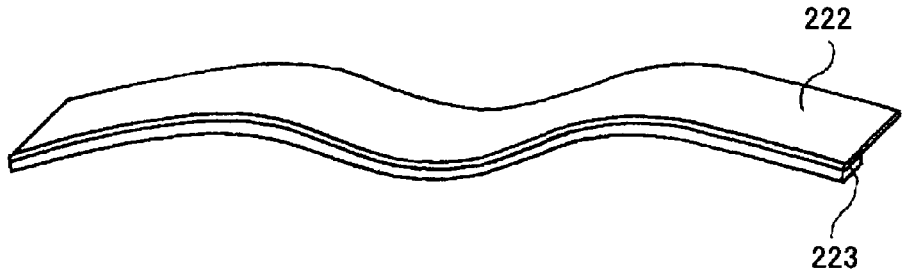
FIG. 27 is a diagram showing a state where no uniform vibration can be obtained along the length of the blade member in the end part thereof according to the second embodiment of the present invention.

By applying voltage to the vibration application members (PZTs) 221, an end (end part) of the blade member 223 deflects. FIGS. 24A and 24B are a front view and a right side view, respectively, of the cleaning blade 220 in the case of applying voltages of the same phase to the vibration application members 221 in PZT in-plane directions of the blade member 223 indicated by arrow in FIG. 24A. In the case of applying voltage in the same phase as shown in FIG. 24A, unless affected greatly by a mode of vibration at the time of resonance determined by the configuration of the cleaning blade 220, vibration can be obtained without a phase difference at the end (end part) of the blade member 223 along its length as shown in FIG. 25. As a result, a cleaning characteristic can be obtained with uniformity along the length of the blade member 223. However, if the vibration application members 221 make antiphase movements as shown in FIG. 26A, the vibration application members 221 expand and contract to cause the blade member 223 to deflect in different directions. As a result, the end part of the blade member 223 is prevented from making uniform movement along the length of the blade member 223 as shown in FIG. 27. If the end part of the blade member 223 shows behavior as shown in FIG. 27, the cleaning characteristic has a distribution along the length of the blade member 223, thus making it difficult to achieve uniform cleaning effect.

Figure 28:
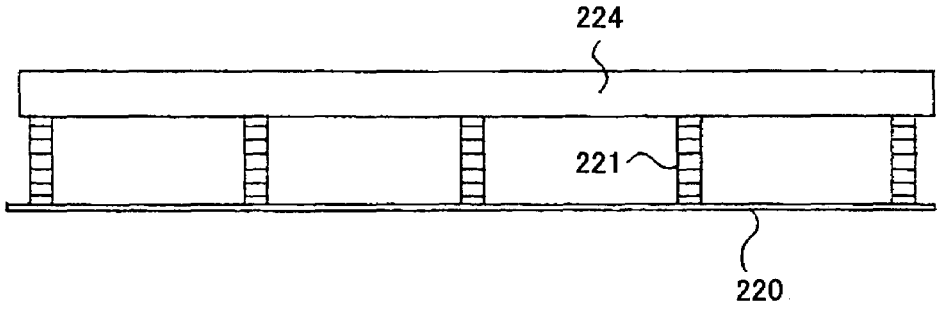
FIG. 28 is a schematic diagram showing a case where a plurality of multilayer PZTs are disposed on the cleaning blade along the length thereof according to the second embodiment of the present invention.
Figure 29:
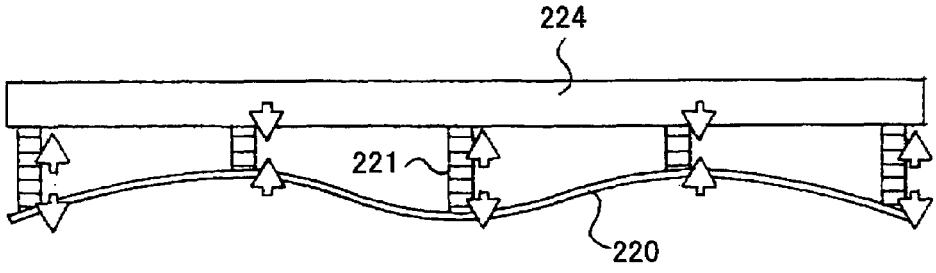
FIG. 29 is a diagram showing a state where no uniform vibration can be obtained along the length of the blade member in the end part thereof when the multilayer PZTs expand and contract in opposite phases in FIG. 28 according to the second embodiment of the present invention.

FIG. 28 is a schematic diagram showing the cleaning blade 220 where the attached vibration application members 221 are of a multilayer type. Referring to FIG. 29, if the multilayer PZTs 221 deform (expand and contract) in opposite phases, the end part of the blade member 223 is prevented from obtaining the same displacement along the length of the blade member 223, thus making it difficult to achieve uniform cleaning effect.

Figure 30:
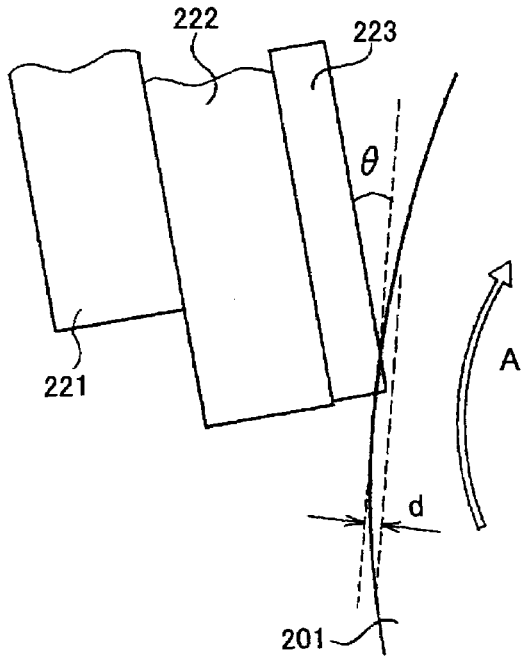
FIG. 30 is a diagram showing the state of contact of the blade member and an image carrier according to the second embodiment of the present invention.

FIG. 30 is a diagram showing the state of contact of the blade member 223 and the image carrier 201. The blade member 223 is in contact with the image carrier 221 in the direction counter to the A direction in which the image carrier 201 rotates. That is, the image carrier 201 moves in a direction such that the angle between the blade member 223 and the image carrier 201 becomes greater than an angle θ at which the blade member 223 is in contact with the image carrier 201. The blade member 223 is pressed, at the end of the nip part thereof, by a pressing force against the image carrier 201 by an amount d in the direction of height with respect to the image carrier 201 (the radial direction of the image carrier 201). That is, as an initial setting, the blade member 223 is pressed further toward the image carrier 201 for the height of the amount d from the contact position of the end of the blade member 223. The initial setting refers to an amount by which the blade member 223 that is not vibrated is pressed against the image carrier 201. According to this embodiment, where the vibration application members 221 are single-plate piezoelectric elements, the amount d corresponds to the deformation of the nip part of the blade member 223 and the deflection (deformation) of the vibration member 222 including the vibration application members 223.

The value of the amount d depends on the thickness and the hardness of the blade member 223. If the blade member 223 is 100 to 300 μm in thickness and 75 to 100° in hardness (JIS-A), the amount d is set to 10 to 100 μm. The amount d is reduced as the blade member 223 becomes smaller in thickness and larger in hardness, and is increased as the blade member 223 becomes larger in thickness and smaller in hardness. The angle θ at which the blade member 223 is in contact with the image carrier 201 may be between 0 and 50° so that cleaning performance can be obtained. The angle θ is set between 0 to 10° when the blade member 223 attached to the vibration member 222 is reduced in length to 2 to 5 mm so that the actual contact of the blade member 23 with the image carrier 201 is reduced in length. When the blade member 223 is greater than or equal to 5 mm in length, the angle θ is set between 10 and 50° so that the edge of the blade member 223 comes into contact with the image carrier 201.

According to the above-described configuration, each of the piezoelectric elements as the vibration application members 221 is between 0.3 to 1.0 mm in thickness and 5 to 20 mm in length and width. The dimensions (specifications) of the vibration member 222 and the blade member 223 are as described above. A condition for driving the piezoelectric elements is a frequency of 17 to 50 kHz, and vibration displacement is 0.1 to 4 μm at the nip part. As a result, the vibration of contraction and the vibration of the easing of the contraction are transmitted to the nip part of the blade member 223 so that cleaning performance with respect to spherical or small-size toner can be obtained through a mechanism described below with reference to FIGS. 31A and 31B.

A vibration provided to the nip part is set to a value smaller than the amount d, so that the effect can be produced stably. That is, the vibrating blade member 223 transmits vibration to the image carrier 201. This reduces a frictional force between the blade member 223 and the image carrier 201, thus eliminating the phenomenon of the turning of the cut surface of the blade member 223. This makes it possible to prevent spherical or small-size toner from entering the blade nip part, thereby eliminating the imperfect cleaning of spherical or small-size toner.

The vibration of the blade member 223 and the transmission of the vibration from the blade member 223 to the image carrier 201 make it possible to cause spherical toner itself to vibrate. As a result, the toner actively vibrates on the surface of the image carrier 201 to lose adsorption to the image carrier 201, so that cleaning performance is improved. Further, a group of vibrating toner particles in the vicinity of the nip part serves as a barrier (a vibration toner wall) to prevent subsequent toner particles from entering the nip part. As a result, no imperfect cleaning occurs with respect to spherical toner, whose particles are substantially spherical in shape. Generally, toner is 8 to 10 μm in average particle size. These days, however, manufacturing methods using polymerization are employed to manufacture spherical toner smaller in particle size so that toner of approximately 5 μm is used. In order to produce the above-described cleaning effect, vibration displacement at the blade end nip part may be smaller than the average particle size of toner. Depending on a driving frequency, even a vibration less than or equal to one tenth of the average particle size of toner can sufficiently produce the cleaning effect.

Figure 31A:
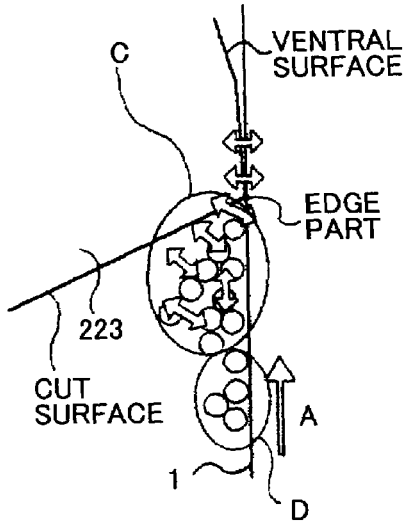
FIG. 31A is a diagram showing a state where the vibrating blade member transmits vibration to spherical toner so that the toner is vibrating actively.
Figure 31B:
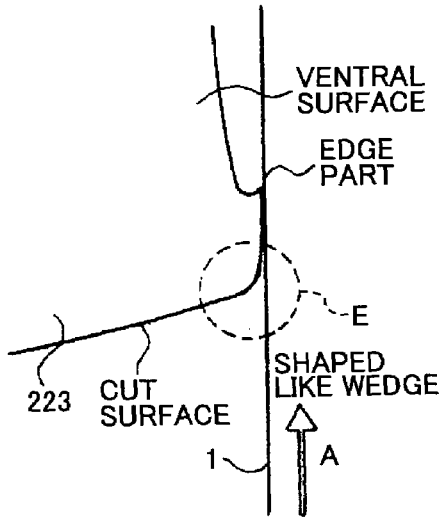
FIG. 31B is a diagram for illustrating the turning of the cut surface of the blade member according to the second embodiment of the present invention.

FIG. 31A is a diagram showing a state where the vibrating blade member 223 transmits vibration to spherical toner so that the toner is vibrating actively. FIG. 31B is a diagram for illustrating the turning of the cut surface of the blade member 223. The state of FIG. 31A was clarified by observation by a high-speed video camera through a high power microscope. It was found out that particles of the spherical toner existing in the vicinity of the end of the blade member 223 and the image carrier 201 are vibrating over the range of a few particles (the range of a part indicated by arrow C). In this state, the vibrating toner group in the vicinity of the nip part (the toner particles of the part C) functions as a barrier (a vibrating toner wall) so as to prevent the entry of subsequent particles of the toner on the image carrier 201 (the toner particles of a part indicated by arrow D). As a result, no imperfect cleaning of the spherical toner, whose particles are substantially spherical in shape, occurs.

It has been discovered that at this point, there exists a condition for eliminating the phenomenon of the turning of the cut surface of the blade member 223, which phenomenon occurs in the conventional cleaning method, as a result of the vibration of the blade member 223 and the transmission of vibration from the blade member 223 to the image carrier 201 reducing the friction between the blade member 223 and the image carrier 201. The "turning of a cut surface" refers to the state where the cut surface of a blade member deforms with the movement of an image carrier so as to come into contact with the surface thereof, forming a wedge-like part as indicated by a broken circle E in FIG. 31B. Normally, the blade member is formed by cutting a formed elastic member in the direction of its thickness and finishing the edge of a cut piece into a sharp shape without burrs or chipping.

It has also been discovered that by preventing the turning of the cut surface of the blade member 223 from occurring, a stress from the blade member 223 to the image carrier 201 is reduced, so that the remarkable effect that a marked improvement is made in the durability of the blade member 223 and the image carrier 201 can be produced.

As described above, it has been understood that cleaning effect is obtained by applying vibration to the vibration member 222. A phenomenon called resonance is caused in the cleaning blade 220 using vibration application because of a vibration application frequency. Resonance is the phenomenon that in the case of applying vibration at a frequency approximating a natural frequency determined by the configuration of the cleaning blade 220, the cleaning blade 220 itself amplifies the vibration in accordance with the vibration application frequency to present various types of behavior. If the movements at the time of resonance cause a gap to be formed between the end part of the blade member 223 and the image carrier 201, toner may slip through the gap depending on the size of the gap, thus resulting in imperfect cleaning. A vibration application method preventing this is desired.

Further, not a few vibration sources exist in the units around the image carrier 201. When the vibration sources transmit vibration to the cleaning blade 220 and the image carrier 201 to cause resonance, a gap is formed between the cleaning blade 220 and the image carrier 201, so that toner may slip through the gap depending on the size of the gap, thus significantly affecting a cleaning characteristic. Accordingly, it is desirable to set suitable driving conditions for a driving system, which is a vibration source, and charging in order to prevent vibration amplification such as a resonance phenomenon caused by externally transmitted vibration.

As described above, the blade member 223 vibrates to transmit vibration to the image carrier 201, thereby eliminating the turning of the cut surface of the blade member 223. At the same time, the image carrier 201 vibrates to transmit vibration to toner on the surface of the image carrier 201 in the vicinity of the blade member 223. By setting a condition for driving the piezoelectric elements (vibration application members) 221 to a frequency of 17 to 50 kHz and setting a vibration displacement to 0.1 to 4 μm at the blade end nip part, it is possible to provide vibration over the range of a few particles in the vicinity of the blade member 223, which particles are not in direct contact with the blade member 223, as shown in FIG. 31A.

Figure 32:
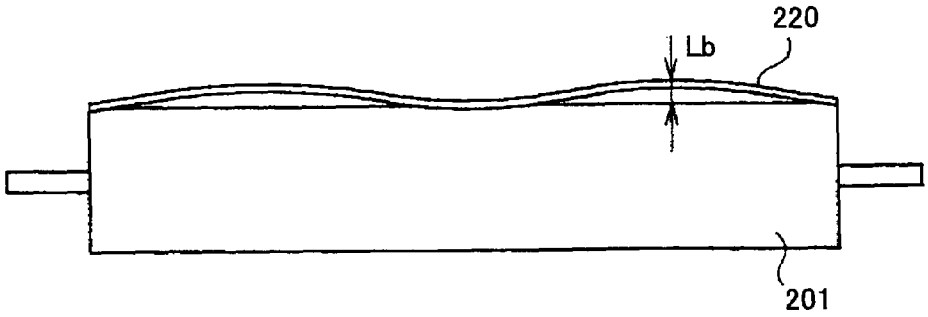
FIG. 32 is a schematic diagram showing a case where the cleaning blade includes deformation in a part thereof contacting the image carrier according to the second embodiment of the present invention.
Figure 33:
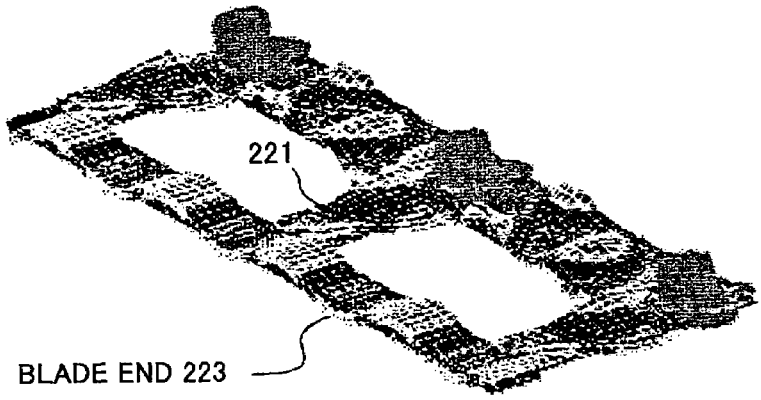
FIG. 33 is a diagram showing the results of the analysis of the vibration of the end of the cleaning blade by a simulation using the finite element method according to the second embodiment of the present invention.

FIG. 32 is a schematic diagram showing a case where the cleaning blade 20 includes deformation in a part thereof contacting the image carrier 201 in the cleaning unit 206. Referring to FIG. 32, if the maximum distance Lb between the end part of the cleaning blade 220 and the image carrier 201 is greater than the average particle size of toner, residual toner may slip through this gap, thus resulting in a reduced cleaning characteristic. FIG. 33 is a diagram showing the results of the analysis of the vibration of the end of the cleaning blade 220 by a simulation using the finite element method. FIG. 33 shows a mode of vibration in the case of applying a frequency of 20.919 Hz to the vibration application members (PZTs) 221. Referring to FIG. 33, the end part of the cleaning blade 220 includes a phase difference along the length of the cleaning blade 220 so as to undulate. If this amplitude is greater than the average particle size of toner, the cleaning characteristic is reduced.

Figure 34:
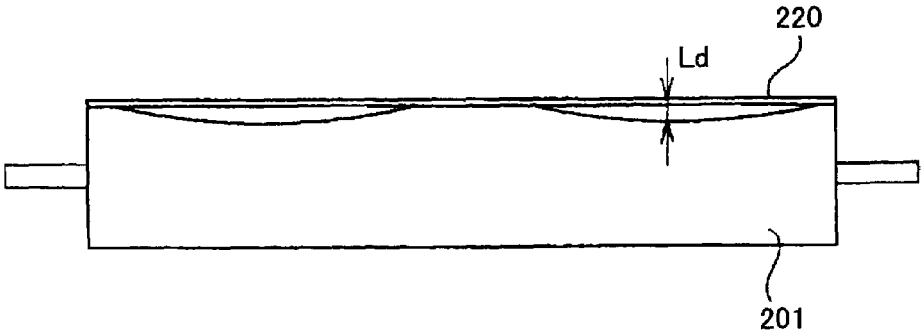
FIG. 34 is a schematic diagram showing a phenomenon where the vibration of the cleaning blade causes vibration to have amplitude in the image carrier according to the second embodiment of the present invention.
Figure 35:
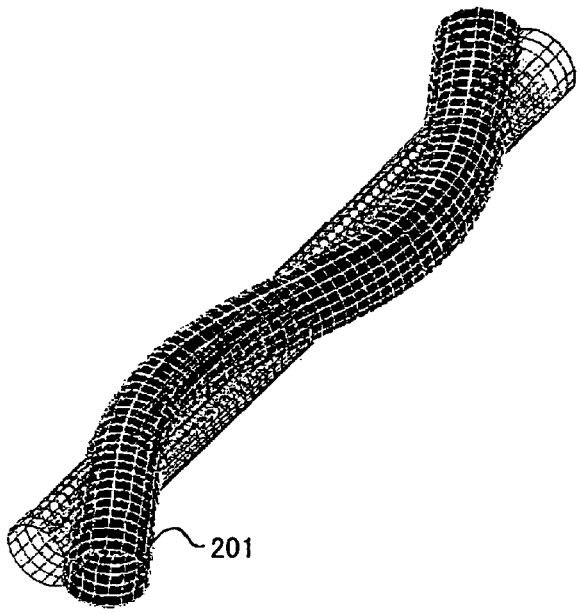
FIG. 35 is a diagram showing a simulation result where a phase difference occurs in a photosensitive body drum, which is the image carrier, along its length according to the second embodiment of the present invention.

FIG. 34 is a schematic diagram showing a phenomenon where the vibration of the cleaning blade 220 causes vibration to have amplitude in the image carrier 201. Referring to FIG. 34, if the maximum amplitude Ld of the image carrier 201 is greater than the average particle size of toner, the toner slips through this gap, thus resulting in a reduced cleaning characteristic. FIG. 35 shows, as a reference, a simulation result where a phase difference occurs in a photosensitive body drum, which is the image carrier 201, along its length.

The above-described reduction in the cleaning characteristic due to the gap between the cleaning blade 220 and the image carrier 201 may be prevented by controlling the voltage applied to the vibration application members 221 of the cleaning blade 220. Even if a mode of vibration occurs in the end of the blade member 220, the "slipping through" of toner may be prevented by making the amplitude (value) smaller than or equal to the average particle size of the toner by controlling the voltage applied to the PZTs 221. Further, the frequency providing the voltage applied to the PZTs 221 may be suitably set to a frequency that can prevent the mode of vibration of the end of the cleaning blade 220 at the time of resonance determined by the structure of the cleaning blade 220 and the image carrier 201 or perform cleaning effectively.

Figure 36:
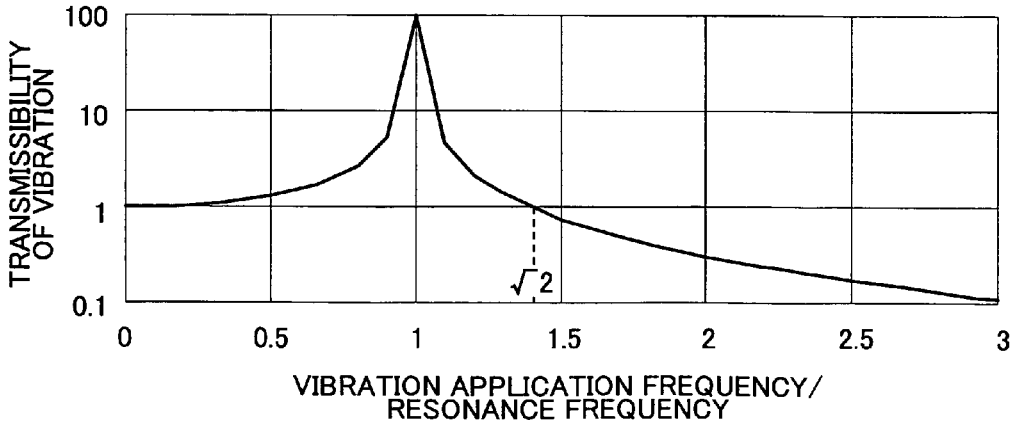
FIG. 36 is a graph of transmissibility of vibration according to the second embodiment of the present invention.

A driving frequency fp applied to the PZTs 221 of the cleaning blade 220 should be above the audible range because vibration is transmitted to the image carrier 201, which serves as a sound reflecting surface to generate noise. Generally, the upper limit of the human audible range is approximately 20 kHz. Frequencies above this limit cause no noise problem. If the frequency fp applied to the PZTs 221 satisfies $f_p > \sqrt{2} \times f_n$, where fn is the resonance frequency of a mode of vibration having nodes in the end (end part) of the cleaning blade 220 as shown in FIG. 33, the behavior of the cleaning blade 220 is free of the influence of a mode of vibration. FIG. 36 shows, as a reference, a graph of transmissibility of vibration where a damping ratio is 0.01.

Generally, in a resonance system, a frequency band $\sqrt{2}$ or more times a resonance frequency is an attenuation band. Accordingly, a mode of vibration causing a problem may be avoided by setting the frequency applied to the PZTs 221 to a frequency within the range defined by the above-described expression.

Figure 37A:
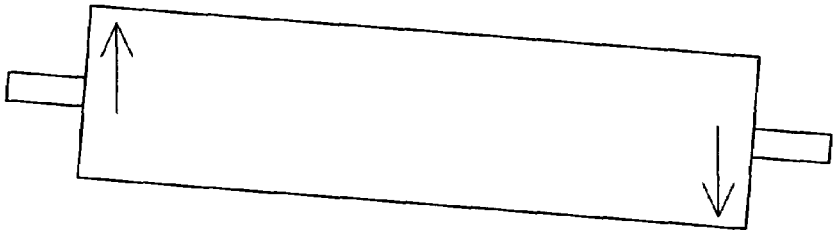
FIGS. 37A through 37C are schematic diagrams showing translational vibrations according to the second embodiment of the present invention.
Figure 37B:
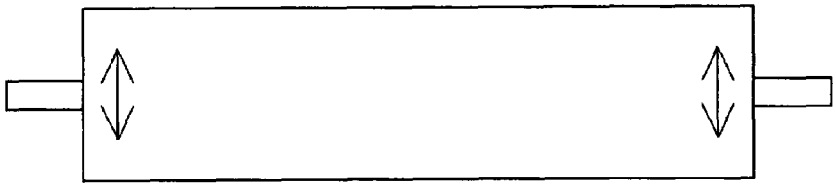
Figure 37C:
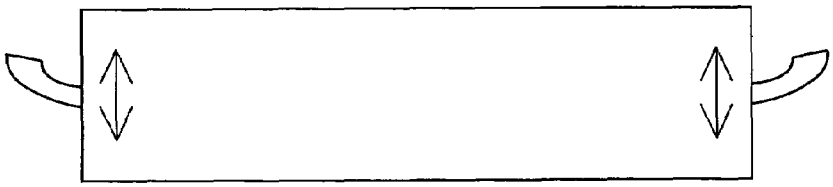

Toner is removed by pressing the cleaning blade 220 against the image carrier 201. A drive member for rotating the image carrier 201 includes a plurality of factors serving as vibration sources. For instance, a vibration generated in a drive transmission mechanism causes the image carrier 201 to vibrate in translational and rotational directions. Translational vibration is behavior generated as a rigid-body mode by, for instance, bearing backlash in a drive system, or is a flexural mode by resonance. A translational vibration of approximately tens of μm occurs depending on the accuracy of the drive system. FIGS. 37A through 37C are schematic diagrams showing translational vibrations as references. FIG. 37A shows a rigid-body mode where phases are opposite at the ends of a shaft. FIG. 37B shows a rigid-body mode where phases are the same at the ends of a shaft. FIG. 37C shows a flexural mode by resonance. Rotational vibration, which is seen mainly in the behavior of speed variation of an image carrier, is often amplified depending on a structural system. When such vibration causes the image carrier 201 to vibrate, vibration is also transmitted to the cleaning blade 220 contacting the image carrier 201, so that a gap is formed between the image carrier 201 and the cleaning blade 220. When the gap becomes greater than or equal to the average particle size of toner, the "slipping through" of the toner occurs, thus resulting in cleaning deficiency.

Figure 38:
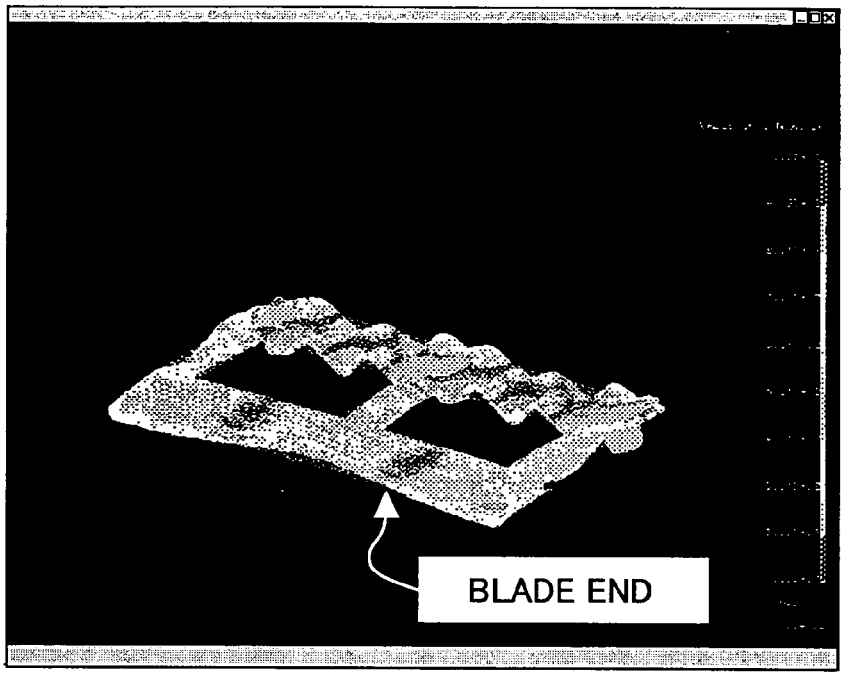
FIG. 38 is a diagram showing a mode of vibration occurring in the end of the cleaning blade according to the second embodiment of the present invention.
Figure 39:
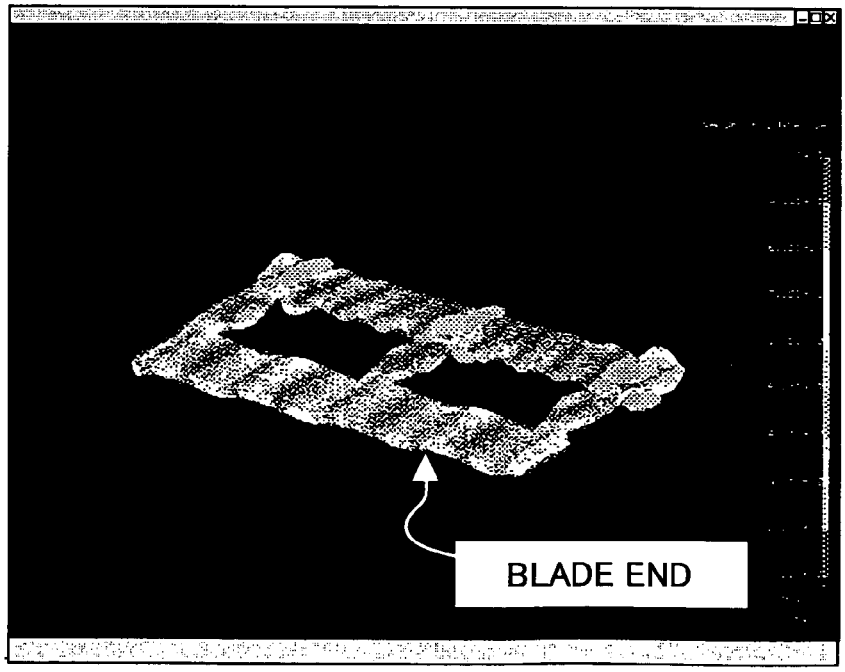
FIG. 39 is a diagram showing another mode of vibration occurring in the end of the cleaning blade according to the second embodiment of the present invention.

When vibration is transmitted from the image carrier 201 to the cleaning blade 220, a mode of vibration occurs in the end of the cleaning blade 220 depending on its vibration characteristic. FIGS. 38 and 39 are diagrams showing modes of vibration actually generated in the end of the cleaning blade 220. The modes of vibration of FIGS. 38 and 39 are generated at different frequencies. The positions and the number of nodes generated in the end of the cleaning blade 220 and the amplitude thereof differ depending on frequencies. Further, the frequency generated by a mode of vibration is determined by the configuration of the cleaning blade 220. Accordingly, when a vibration of a frequency generating a mode of vibration is transmitted from the image carrier 201 to the end of the cleaning blade 220, toner slips through the vibration displacement of the image carrier 201 and the nodes of the mode of vibration of the cleaning blade 220, thus resulting in cleaning deficiency. This problem may be avoided by setting the frequency of vibration generated in the drive member to a driving condition other than a frequency band where the mode of vibration of the cleaning blade 220 occurs.

In the case of a stepper motor as the drive member of the image carrier 201, the rotational vibration of the stepper motor occurs at the frequency of pulses driving the stepper motor. This vibration component is transmitted to the image carrier 201 via gears, which are a drive transmission system, so as to generate rotational vibration in the image carrier 201. If this vibration frequency approximates a frequency causing a mode of vibration in the end of the cleaning blade 220, the cleaning blade 220 behaves as shown in FIG. 38 or 39 so as to form a gap in the vibration displacement of the image carrier 201 and at a node of the mode of vibration of the end of the cleaning blade 220. As a result, the "slipping through" of toner occurs. Accordingly, this problem may be avoided by setting the driving frequency of the stepper motor to a condition other than a frequency band where the mode of vibration of the cleaning blade 220 occurs.

When the motor, or the drive member, of the image carrier 201 is a servo motor, north and south poles are alternately disposed in the rotor of the motor. Letting the number of poles be s and the number of phases be m, a rotational vibration of a frequency determined by (s×m) occurs as a peak. The vibration of this frequency occurs in the motor is amplified by gears, which are a transmission system. Then, the vibration becomes an integral multiple of a fundamental frequency component because of, for instance, eccentricity, and is transmitted to the image carrier 201 so as to be the rotational vibration of the image carrier 201. If this vibration frequency approximates a frequency causing a mode of vibration in the end of the cleaning blade 220, the cleaning blade 220 behaves as shown in FIG. 38 or 39 so as to form a gap in the vibration displacement of the image carrier 201 and at a node of the mode of vibration of the end of the cleaning blade 220. As a result, the "slipping through" of toner occurs. Accordingly, this problem may be avoided by setting the frequency of (s×m) determined by the number of poles s and the number of phases m of the motor to a condition other than a frequency band where the mode of vibration of the cleaning blade 220 occurs.

Figure 40:
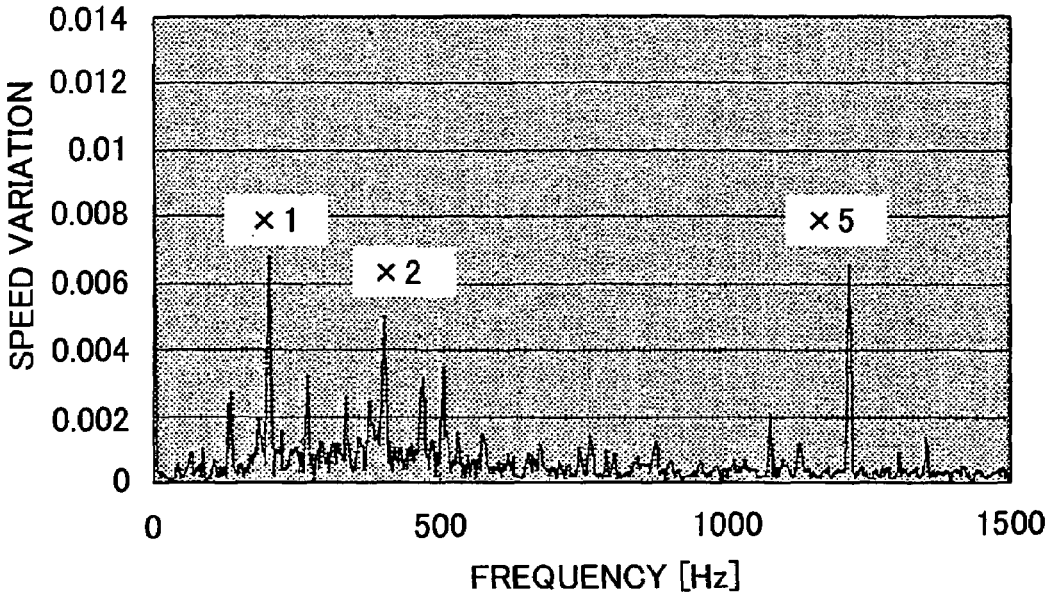
FIG. 40 is a graph showing a distribution of speed variations of the image carrier generated at a gear meshing frequency according to the second embodiment of the present invention.

As the drive transmission mechanism of the image carrier 201, a gear train is employed. In the case of employing a gear for a drive transmission system, rotational vibration almost always occurs depending on the meshing frequency of the gear. The meshing frequency of a gear is a frequency determined by (z×r), where z is the number of gear rotations and r is the number of gear teeth. A speed variation is caused in the image carrier 201, which is a rotated body, by rotational vibration at this frequency. FIG. 40 is a graph showing a distribution of speed variations of the image carrier 201 generated at a gear meshing frequency. The distribution is the result of a case where the number of rotations of a gear, which is a drive transmission system, is 6 rps, and the number of gear teeth is 34. The meshing frequency is 204 Hz indicated by "×1" in FIG. 40 at which a peak speed variation occurs. If this vibration frequency approximates a frequency causing a mode of vibration in the end of the cleaning blade 220, the cleaning blade 220 behaves as shown in FIG. 38 or 39 so as to form a gap in the vibration displacement of the image carrier 201 and at a node of the mode of vibration of the end of the cleaning blade 220. As a result, the "slipping through" of toner occurs. Accordingly, this problem may be avoided by setting the meshing frequency determined by (z×r) based on the number of rotations r and the number of teeth z of a gear to a condition other than a frequency band where the mode of vibration of the cleaning blade 220 occurs.

The meshing vibration of a gear is affected by the eccentricity of a drive transmission system or, in the case of multiple gears, other gears so as to generate vibrations of integral multiples of the meshing frequency. FIG. 40 shows that in the image carrier 201, vibration components are generated at 408 Hz (×2), which is twice the meshing frequency 204 Hz, and 1020 Hz (×2), which is five times the meshing frequency 204 Hz. If these vibration frequencies approximate a frequency causing a mode of vibration in the end of the cleaning blade 220, the cleaning blade 220 behaves as shown in FIG. 38 or 39 so as to form a gap in the vibration displacement of the image carrier 201 and at a node of the mode of vibration of the end of the cleaning blade 220. As a result, the "slipping through" of toner occurs. Accordingly, this problem may be avoided by setting a frequency that is an integral multiple of a gear meshing frequency to a condition other than a frequency band where the mode of vibration of the cleaning blade 220 occurs.

Figure 41:
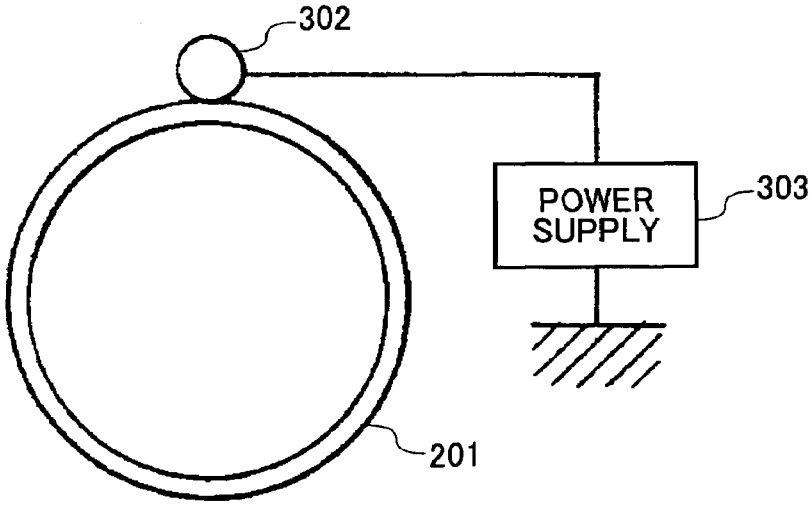
FIG. 41 is a schematic diagram showing a method of charging the image carrier using a charging roller according to the second embodiment of the present invention.
Figure 42:
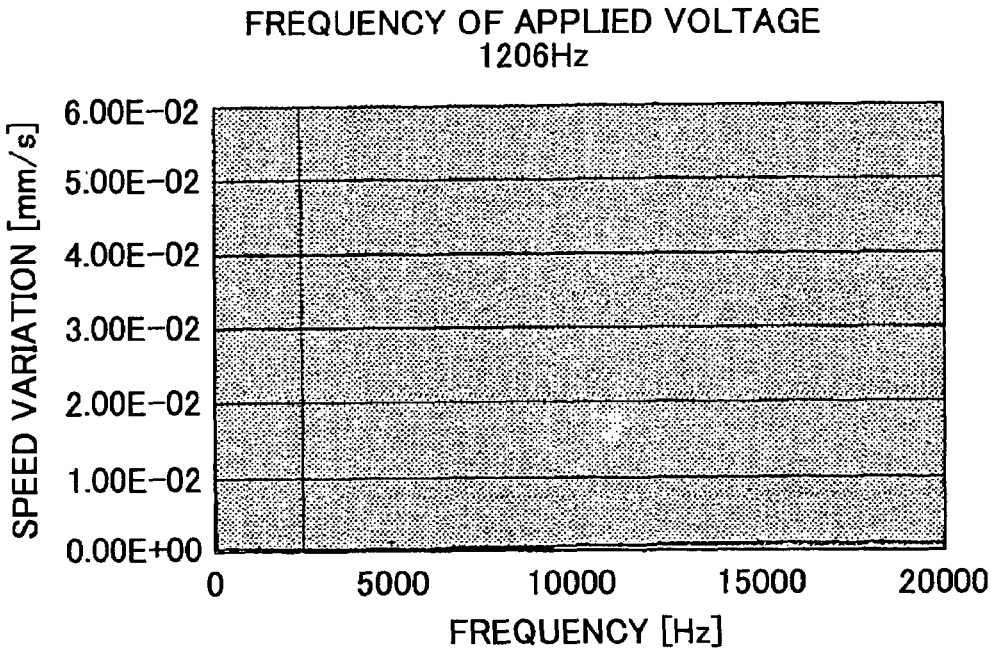
FIG. 42 is a graph showing the speed variation of the image carrier in the case of applying voltage to the charging roller according to the second embodiment of the present invention.

FIG. 41 is a schematic diagram showing a method of charging the image carrier (photosensitive body drum) 201, which is an electrostatic latent image carrier, using a charging roller 302 in an image-forming apparatus. Referring to FIG. 41, a voltage is applied from a power supply 303 to the charging roller 302 so that the image carrier 201 is charged. At this point, the voltage applied to the charging roller 302 is the combination of a direct current component $V_{DC}$ and an alternating current component $V_{AC}$ of a frequency $f_{AC}$ [Hz]. The charging roller 302 and the surface of the image carrier 201 attract each other through electrostatic force. However, since the applied voltage is an alternating current, a variation is caused in the attraction, so that vibration is applied to the image carrier 201 at a frequency twice the frequency $f_{AC}$ [Hz] of the voltage applied to the charging roller 302. FIG. 42 is a graph showing the speed variation of the image carrier 201 in the case of applying voltage to the charging roller 302 with an alternating current of $f_{AC}$=1206 Hz. Referring to FIG. 42, the speed variation peaks at 2412 Hz, which is twice the frequency $f_{AC}$ of 1206 Hz, thus showing that the image carrier 201 vibrates at a frequency twice the frequency of the applied voltage.

Figure 43:
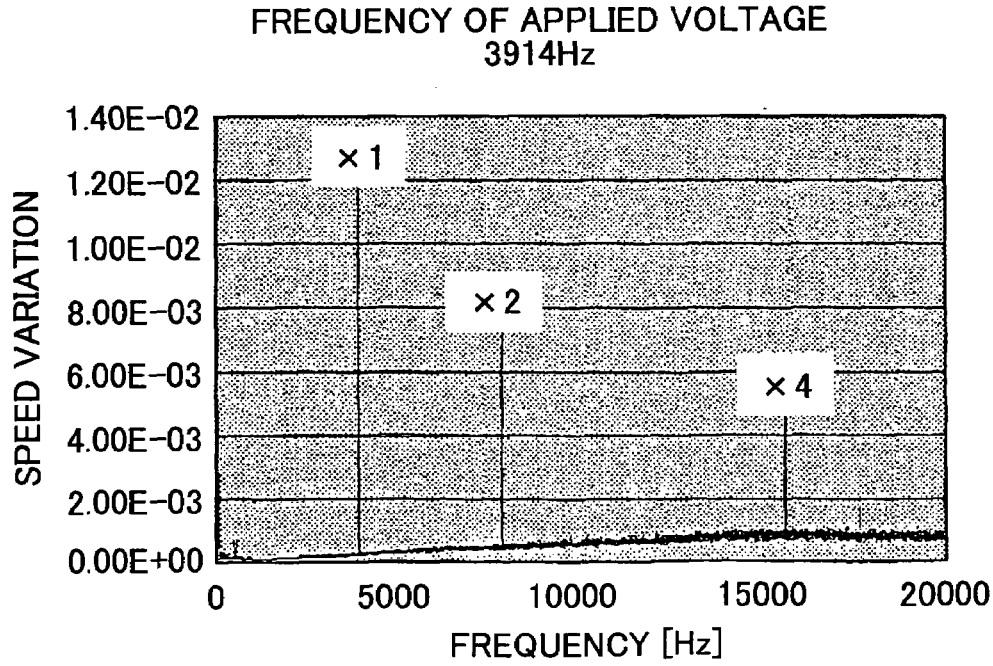
FIG. 43 is a graph showing the speed variation vibration of the image carrier in a case where the charging roller has a resonance frequency at a frequency that is an integral multiple of the frequency of a voltage applied to the charging roller according to the second embodiment of the present invention.

In many cases, as shown in FIG. 42, a vibration application component generated by the charging roller 302 causes vibration at a frequency twice the frequency of an applied voltage. However, depending on the vibration characteristics of the image carrier 201 and the charging roller 302, different vibrations may be generated. FIG. 43 is a graph showing the speed variation vibration of the image carrier 201 in the case where the charging roller 302 has a resonance frequency at a frequency that is an integral multiple of the frequency of the voltage applied to the charging roller 302. In the case of FIG. 43, the frequency of the voltage applied to the charging roller 302 is 3914 Hz. The vibration components of 3,914 Hz, 7,828 Hz, and 15,656 Hz, which are frequencies of integral multiples (×1, ×2, and ×4, respectively) of the frequency of the applied voltage, are particularly outstanding peaks. If these vibration frequencies approximate a frequency causing a mode of vibration in the end of the cleaning blade 220, the cleaning blade 220 behaves as shown in FIG. 38 or 39 so as to form a gap in the vibration displacement of the image carrier 201 and at a node of the mode of vibration of the end of the cleaning blade 220. As a result, the "slipping through" of toner occurs. Accordingly, this problem may be avoided by setting a frequency that is an integral multiple of the frequency of an AC bias applied to a charging roller to a condition other than a frequency band where the mode of vibration of the cleaning blade 220 occurs.

Figure 44:
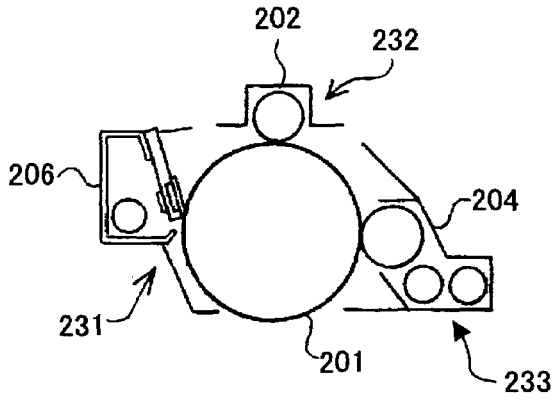
FIG. 44 is a schematic sectional view of process cartridges according to the second embodiment of the present invention.

FIG. 44 is a schematic sectional view of process cartridges 231 through 233 according to this embodiment. Two or more of components such as the image carrier 201, the charging unit 202, the development unit 204, and the cleaning unit 206 are integrated into any of the process cartridges 231 through 233. The process cartridges 231 through 233 are detachably attached to the main body of an image-forming apparatus (not graphically represented) such as a copier or a printer. The cleaning unit 206 is provided in the freely attachable and detachable process cartridge 231. As a result, better maintainability can be achieved, and the cleaning unit 206 can be replaced easily by replacing the process cartridge 231 as a unit.

Next, a description is given of a suitable configuration for a color image-forming apparatus using a process cartridge including the cleaning unit 206 according to this embodiment.

Figure 45:
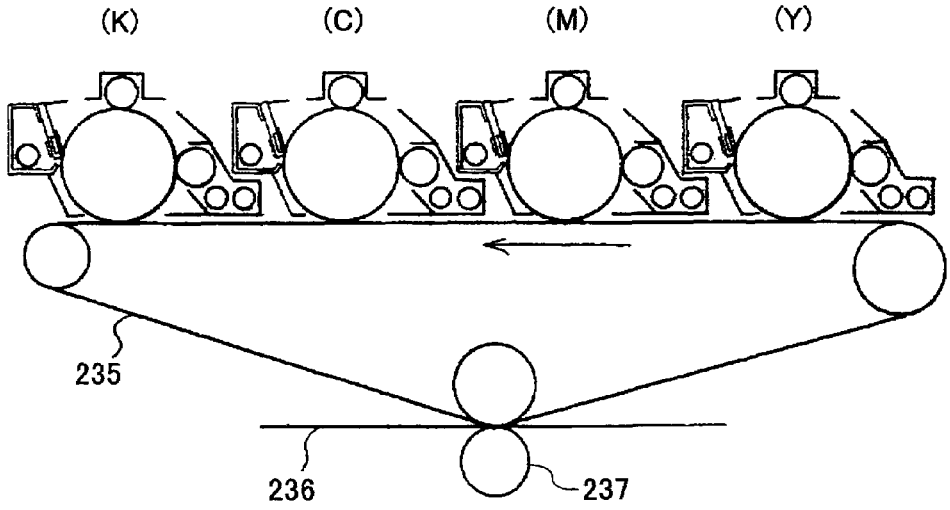
FIG. 45 is a diagram showing a color image-forming apparatus in which the process cartridges are juxtaposed along a laterally extending transfer belt according to the second embodiment of the present invention.

FIG. 45 is a diagram showing the color image-forming apparatus in which the above-described process cartridges 231 through 233 are juxtaposed along a laterally extending transfer belt 235. The process cartridges 231 through 233 are provided for each of four colors: yellow (Y), magenta (M), cyan (C), and black (K). Toner images developed on the image carriers 201 by the process cartridges 233 including the development units 204 are successively transferred onto the laterally extending transfer belt 235 to which a transfer voltage is applied. Thus, a yellow image, a magenta image, a cyan image, and a black image are successively formed and transferred onto the transfer belt 235 by multilayer transfer so as to be transferred together onto the transfer material 236 by a transfer unit 237. A multilayer (composite) toner image on the transfer material 236 is fixed by a fixing unit (not graphically represented). The sets of the process cartridges 231 through 233 are arranged in the order of yellow, magenta, cyan, and black as described above. However, the order of arrangement is not limited to this, and the sets may be juxtaposed in any order.

Conventionally, a color image-forming apparatus, which includes a plurality of image formation parts, is large in size. Further, when individual units such as a cleaning unit and a charging unit fail or reach the end of their useful service life, and have to be replaced, it takes a lot of time and effort to replace units due to the complexity of the apparatus.

Therefore, according to this embodiment, by integrating the image carrier 201, the charging unit 202, the development unit 204, and the cleaning unit 206 into the process cartridges 231 through 233, a small-size, highly durable color image-forming apparatus whose units can be replaced easily by a user can be provided.

Thus, according to this embodiment, a cleaning unit and an image-forming apparatus that can remove toner, particularly spherical toner and small-size toner, without the occurrence of cleaning deficiency caused by the toner slipping through the gap between a blade and an image carrier, thus achieving stable cleaning performance, can be provided.

The present invention is not limited to the specifically disclosed embodiments, and variations and modifications may be made without departing from the scope of the present invention.

The present application is based on Japanese priority patent applications No. 2003-103234, filed on Apr. 7, 2003, and No. 2003-131113 filed on May 9, 2003, the entire contents of which are hereby incorporated by reference.

What is claimed is:

1. A cleaning unit for removing toner remaining on a surface of an image carrier of an image-forming apparatus, comprising:

a vibration member extending in a direction of a width of the image carrier, the vibration member having at least one vibration application part attached thereto;

a blade member attached to at least an end region of the vibration member, the blade member extending in the direction of the width of the image carrier; and a driving part configured to drive the at least one vibration application part at a driving frequency, the driving frequency being a natural resonance frequency occurring at a time of assembly of the blade member and the image carrier, wherein the vibration member is configured to provide vibration to the blade member and a force to press the blade member against the image carrier, and wherein the at least one vibration application part and the blade member are disposed on a first side and a second side, respectively, of the vibration member at a free end thereof which is engageable with the image carrier and which are oriented parallel to one another, the first side and the second side of the vibration member facing away from each other.

2. The cleaning unit as claimed in claim 1, wherein the driving part is configured to be capable of changing the driving frequency.

3. The cleaning unit as claimed in claim 2, wherein the driving frequency of the driving part is set based on frictional resistance between the blade member and the image carrier.

4. The cleaning unit as claimed in claim 3, wherein the driving frequency of the driving part is set based on a coefficient of friction of the surface of the image carrier.

5. The cleaning unit as claimed in claim 3, wherein the driving frequency of the driving part is set based on rotational torque of the image carrier.

6. The cleaning unit as claimed in claim 3, wherein the driving frequency of the driving part is set based on a result of detection of a cleaning characteristic.

7. The cleaning unit as claimed in claim 1, wherein the at least one vibration application part includes a piezoelectric element.

8. The cleaning unit as claimed in claim 1, wherein the toner is polymerized toner formed by polymerization.

9. The cleaning unit as claimed in claim 1, wherein the resonance frequency is determined by the blade member and the image carrier.

10. The cleaning unit as claimed in claim 1, wherein the blade member has a thickness of 100 to 500 μm.

11. A process cartridge freely attachable to and detachable from a main body of an image forming apparatus, comprising:

at least one of an image carrier, a charging unit, a development unit, and a transfer unit; and a cleaning unit configured to remove toner remaining on a surface of the image carrier, the cleaning unit including:

a vibration member extending in a direction of a width of the image carrier, the vibration member having at least one vibration application part attached thereto;

a blade member attached to at least an end region of the vibration member, the blade member extending in the direction of the width of the image carrier; and a driving part configured to drive the at least one vibration application part at a driving frequency, the driving frequency being a natural resonance frequency occurring at the time of assembly of the blade member and the image carrier, wherein the vibration member is configured to provide vibration to the blade member and a force to press the blade member against the image carrier, and wherein the at least one vibration application part and the blade member are disposed on a first side and a second side, respectively, of the vibration member at a free end thereof which is engageable with the image carrier and which are oriented parallel to one another, the first side and the second side of the vibration member facing away from each other.

12. The process cartridge as claimed in claim 11, wherein the blade member has a thickness of 100 to 500 μm.

13. An image-forming apparatus forming an image by electrophotography, comprising:

a cleaning unit configured to remove toner remaining on a surface of an image carrier of the image-forming apparatus, the cleaning unit including:

a vibration member extending in a direction of a width of the image carrier, the vibration member having at least one vibration application part attached thereto;

a blade member attached to at least an end region of the vibration member, the blade member extending in the direction of the width of the image carrier; and a driving part configured to drive the at least one vibration application part at a driving frequency, the driving frequency being a natural resonance frequency occurring at the time of assembly of the blade member and the image carrier, wherein the vibration member is configured to provide vibration to the blade member and a force to press the blade member against the image carrier, and wherein the at least one vibration application part and the blade member are disposed on a first side and a second side, respectively, of the vibration member at a free end thereof which is engageable with the image carrier and which are oriented parallel to one another, the first side and the second side of the vibration member facing away from each other.

14. The image-forming apparatus as claimed in claim 13, wherein the blade member has a thickness 100 to 500 μm.

15. An image-forming apparatus forming a color image, comprising:

a plurality of process cartridges freely attachable to and detachable from a main body of the image forming apparatus, the process cartridges each including:

at least one of an image carrier, a charging unit, a development unit, and a transfer unit; and a cleaning unit configured to remove toner remaining on a surface of the image carrier, the cleaning unit including:

a vibration member extending in a direction of a width of the image carrier, the vibration member having at least one vibration application part attached thereto;

a blade member attached to at least an end region of the vibration member, the blade member extending in the direction of the width of the image carrier; and a driving part configured to drive the at least one vibration application part at a driving frequency, the driving frequency being a natural resonance frequency occurring at the time of assembly of the blade member and the image carrier, wherein the vibration member is configured to provide vibration to the blade member and a force to press the blade member against the image carrier, and wherein the at least one vibration application part and the blade member are disposed on a first side and a second side, respectively, of the vibration member at a free end thereof which is engageable with the image carrier and which are oriented parallel to one another, the first side and the second side of the vibration member facing away from each other.

16. The image-forming apparatus as claimed in claim 15, wherein the blade member has a thickness of 100 to 500 μm.

* * * * *